US012404734B2

(12) United States Patent
Mitchell et al.

(10) Patent No.: US 12,404,734 B2
(45) Date of Patent: Sep. 2, 2025

(54) LOCK RING ACTUATOR FOR TUBING HANGER INSTALLATION

(71) Applicant: Innovex International, Inc., Houston, TX (US)

(72) Inventors: Andrew B. Mitchell, Houston, TX (US); Chris D. Bartlett, Houston, TX (US); David Scantlebury, Houston, TX (US); Rick Murphy, Houston, TX (US); Fife B. Ellis, Houston, TX (US); Gregory Norwood, Houston, TX (US)

(73) Assignee: Innovex International, Inc., Houston, TX (US)

( * ) Notice: Subject to any disclaimer, the term of this patent is extended or adjusted under 35 U.S.C. 154(b) by 0 days.

(21) Appl. No.: 18/409,334

(22) Filed: Jan. 10, 2024

(65) Prior Publication Data

US 2024/0151116 A1 May 9, 2024

Related U.S. Application Data

(63) Continuation-in-part of application No. 17/957,921, filed on Sep. 30, 2022, now Pat. No. 12,152,456, (Continued)

(51) Int. Cl.
*E21B 33/04* (2006.01)
*E21B 33/043* (2006.01)
*E21B 41/00* (2006.01)

(52) U.S. Cl.
CPC ..... *E21B 33/0415* (2013.01); *E21B 33/043* (2013.01); *E21B 41/0021* (2013.01)

(58) Field of Classification Search
CPC .... E21B 17/046; E21B 33/04; E21B 33/0415; E21B 33/0422; E21B 33/043
See application file for complete search history.

(56) References Cited

U.S. PATENT DOCUMENTS 3,664,689 A * 5/1972 Hanes ..... E21B 33/043 285/321
4,067,385 A 1/1978 Schwager et al.
(Continued)

FOREIGN PATENT DOCUMENTS

GB 2200154 A 7/1988
GB 2233364 A 1/1991
(Continued)

OTHER PUBLICATIONS

Search Report issued in related United Kingdom Patent Application No. GB2019380.1 dated May 27, 2021, 1 page.
(Continued)

*Primary Examiner* — Jennifer H Gay
(74) *Attorney, Agent, or Firm* — Baker Botts L.L.P.

(57) ABSTRACT

A hanger assembly includes: a main body; a lock ring coupled to the main body and configured to expand radially outward into a profile on an inner diameter of the wellhead; and an actuator, wherein the actuator is capable of transferring an axial force from the actuator into outward radial expansion of the lock ring toward the profile on the inner diameter of the wellhead. An interface between the actuator and the lock ring is shaped such that: axially downward movement of the actuator from a starting position to an intermediate position actuates the lock ring into the profile; and axially downward movement of the actuator from the intermediate position to a pre-load position applies a pre-load to the hanger assembly.

19 Claims, 27 Drawing Sheets

Related U.S. Application Data which is a continuation-in-part of application No. 17/118,100, filed on Dec. 10, 2020, now Pat. No. 11,459,843.

(60) Provisional application No. 62/947,506, filed on Dec. 12, 2019.

(56) References Cited

U.S. PATENT DOCUMENTS

| | | | | |
|---|---|---|---|---|
| 4,561,499 | A * | 12/1985 | Berner, Jr. | E21B 33/043 166/341 |
| 4,595,063 | A * | 6/1986 | Jennings | E21B 33/043 285/123.4 |
| 4,770,248 | A | 9/1988 | Houlgrave et al. | |
| 4,815,770 | A * | 3/1989 | Hyne | E21B 33/043 285/915 |
| 5,076,356 | A | 12/1991 | Reimert | |
| 5,205,356 | A | 4/1993 | Bridges et al. | |
| 5,503,230 | A | 4/1996 | Osborne et al. | |
| 7,743,832 | B2 * | 6/2010 | Shaw | E21B 33/043 166/368 |
| 8,387,708 | B2 * | 3/2013 | Anderson | E21B 33/04 166/217 |
| 8,950,752 | B2 * | 2/2015 | Gette | E21B 33/0422 277/323 |
| 10,066,456 | B2 * | 9/2018 | Berryhill | E21B 33/035 |
| 10,100,595 | B2 * | 10/2018 | Nguyen | E21B 33/04 |
| 10,287,839 | B2 * | 5/2019 | Lugtmeier | E21B 33/04 |
| 11,072,984 | B2 * | 7/2021 | Queiroz | E21B 23/02 |
| 11,459,843 | B2 * | 10/2022 | Bartlett | E21B 33/04 |
| 2003/0145996 | A1 | 8/2003 | Singeetham et al. | |
| 2008/0230229 | A1 * | 9/2008 | Shaw | E21B 33/035 166/344 |
| 2009/0211761 | A1 | 8/2009 | Broussard | |
| 2010/0078176 | A1 | 4/2010 | Christie | |
| 2010/0101800 | A1 | 4/2010 | June et al. | |
| 2011/0316236 | A1 * | 12/2011 | Gette | E21B 33/0422 277/312 |
| 2012/0043094 | A1 * | 2/2012 | Anderson | E21B 33/04 166/382 |
| 2013/0126181 | A1 | 5/2013 | Bell | |
| 2013/0299193 | A1 * | 11/2013 | Duong | E21B 33/04 166/208 |
| 2015/0041151 | A1 * | 2/2015 | Cocker, III | E21B 33/0415 166/380 |
| 2016/0186523 | A1 | 6/2016 | Nguyen | |
| 2016/0265298 | A1 * | 9/2016 | Nguyen | E21B 33/04 |
| 2016/0326824 | A1 * | 11/2016 | Lugtmeier | E21B 33/04 |
| 2017/0058622 | A1 * | 3/2017 | Nguyen | E21B 43/10 |
| 2017/0152721 | A1 * | 6/2017 | Bories | E21B 33/047 |
| 2017/0159399 | A1 * | 6/2017 | Sommerfeld | E21B 33/04 |
| 2017/0167218 | A1 * | 6/2017 | Cheah | E21B 23/02 |
| 2017/0191335 | A1 * | 7/2017 | Nguyen | E21B 33/0353 |
| 2017/0198540 | A1 * | 7/2017 | Chirko | E21B 33/04 |
| 2017/0254166 | A1 * | 9/2017 | Berryhill | E21B 33/035 |
| 2017/0342805 | A1 | 11/2017 | Minnock et al. | |
| 2018/0163491 | A1 * | 6/2018 | Nguyen | E21B 33/04 |
| 2018/0258726 | A1 * | 9/2018 | Levert, Jr. | E21B 33/04 |
| 2020/0399973 | A1 * | 12/2020 | Mitchell | E21B 33/0407 |
| 2021/0010340 | A1 * | 1/2021 | Queiroz | E21B 23/02 |
| 2021/0062603 | A1 * | 3/2021 | Cheng | F16J 15/028 |
| 2021/0087899 | A1 * | 3/2021 | DeBerry | E21B 33/043 |
| 2021/0180425 | A1 * | 6/2021 | Bartlett | E21B 41/0021 |
| 2021/0317718 | A1 * | 10/2021 | Mora | E21B 33/04 |
| 2024/0151116 | A1 * | 5/2024 | Mitchell | E21B 33/043 |

FOREIGN PATENT DOCUMENTS

| | | | |
|---|---|---|---|
| GB | 2256664 | A | 12/1992 |
| GB | 2262298 | A | 6/1993 |
| GB | 2397312 | A | 7/2004 |
| WO | WO2009014795 | A2 | 1/2009 |
| WO | WO2018226239 | A1 | 12/2018 |
| WO | WO2019093997 | A1 | 5/2019 |
| WO | WO2019209298 | A1 | 10/2019 |
| WO | WO2020204729 | A1 | 10/2020 |

OTHER PUBLICATIONS

Patents Act 1977: Search report under section 17(5), Application No. GB2314260.7, Feb. 27, 2024, 3 pages.

Notification of transmittal of the international search report and the written opinion of the international searching authority, or the declaration, International application No. PCT/US2025/010115, mailed Apr. 17, 2025, 11 pages.

* cited by examiner

LOCK RING ACTUATOR FOR TUBING HANGER INSTALLATION

CROSS REFERENCE TO RELATED APPLICATIONS

This application is a continuation-in-part of U.S. application Ser. No. 17/957,921, entitled "RIGIDIZED SEAL ASSEMBLY USING AUTOMATED SPACE-OUT MECHANISM", filed on Sep. 30, 2022, which is a continuation-in-part of U.S. application Ser. No. 17/118,100, entitled "TUBING HANGER SPACE-OUT MECHANISM", filed on Dec. 10, 2020, now U.S. Pat. No. 11,459,843, issued Oct. 4, 2022, which claims the benefit of U.S. Provisional Patent Application No. 62/947,506, entitled "TUBING HANGER SPACE-OUT MECHANISM", filed on Dec. 12, 2019, the entire disclosures of which are incorporated herein by reference.

BACKGROUND

Conventional wellhead systems include a wellhead housing and a subsurface casing string extending from the wellhead into the well bore. During a drilling procedure, a drilling riser and BOP are installed above a wellhead housing (casing head) to provide pressure control as casing is installed, with each casing string having a casing hanger on its upper end for landing on a shoulder within the wellhead housing. Successive casing hangers carrying casing strings of decreasing diameter are installed through the wellbore, and then, a tubing string is installed through the well bore. A tubing hanger connectable to the upper end of the tubing string is supported within the wellhead housing above the last casing hanger, which carries the smallest diameter casing string, for suspending the tubing string within the casing string. Upon completion of this process, the BOP is replaced by a Christmas tree installed above the wellhead housing, with the tree having a valve to enable the oil or gas to be produced and directed into flow lines for transportation to a desired facility.

For various reasons, a tubing hanger or casing hanger within the wellhead may move axially upward, particularly when the wellhead is part of a production system where downhole fluids at elevated temperatures thermally expand the casing string and thus exert a substantial upward force on the casing hanger. Since the casing hanger seal is intended for sealing at a particular location on the wellhead, upward movement of the casing hanger and the seal assembly is detrimental to reliably sealing the casing annulus. Further, for various reasons, the casing hanger may stack higher than intended. Thus, it must be ensured that the tubing hanger is properly sized to lock to the wellhead and that the casing hanger is prevented from moving axially in response to such axial forces.

Various tubing hanger designs and methods have been conceived of for ensuring the tubing hanger is locked to the wellhead housing and the tubing hanger system and casing hanger are rigidized (locked axially) within the wellhead housing. A tubing hanger, once run in and locked into the wellhead, is intended to prevent axial movement of the uppermost casing hanger and seal assembly with respect to the wellhead. Typically, a tubing hanger is run into the wellhead, landed on the casing hanger, and locked to a locking profile on an inner wall of the wellhead housing, which also acts to secure the casing hanger within the wellhead. To install existing tubing hangers, it is first necessary to run a lead impression tool into the wellhead to measure the distance between the top of the casing hanger and the housing locking profile. The lead impression tool is a small block of soft metal, usually lead, which is lowered into the wellhead to take an impression to determine the internal profile of the wellhead, which after being retrieved can be measured to determine the distance between the top of the casing hanger and the housing locking profile. With this information, the tubing hanger can be adjusted at the surface so that once the tubing hanger is run in and secured to the wellhead, it provides a zero-gap connection between the tubing hanger, the casing hanger, and the wellhead housing and creates any desired pre-load.

This process of taking measurements in the wellhead via a lead impression tool, retrieving the tool to the surface, and then adjusting and installing a tubing hanger into the wellhead is a time-consuming installation process requiring multiple trips into the wellhead. It is now recognized that a need exists for a tubing hanger system that allows for a single-trip installation process.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1A:
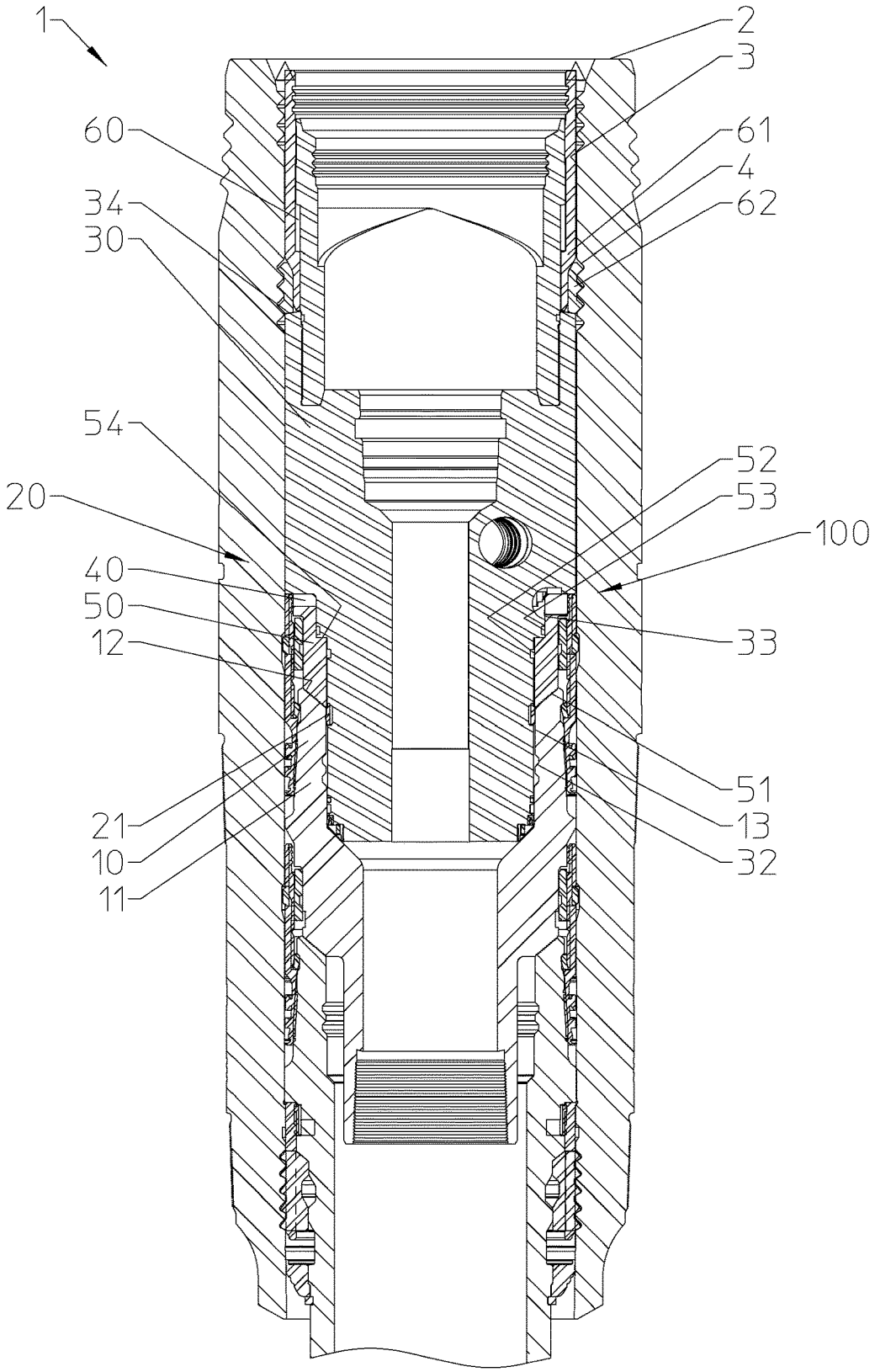
FIG. 1A is a partial cutaway view of a wellhead system having a tubing hanger system, in accordance with an embodiment of the present disclosure.
Figure 1B:
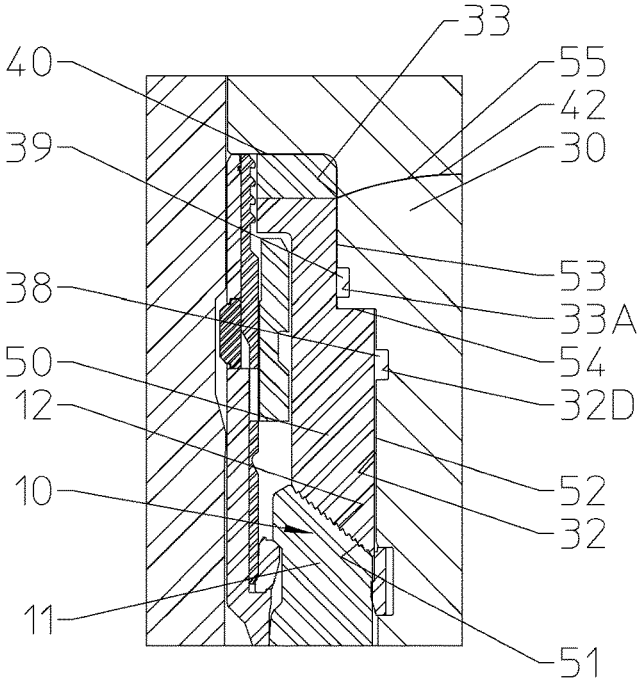
FIG. 1B is a close-up of the partial cutaway view of the wellhead system having the tubing hanger system of FIG. 1A, in accordance with an embodiment of the present disclosure.
Figure 1C:
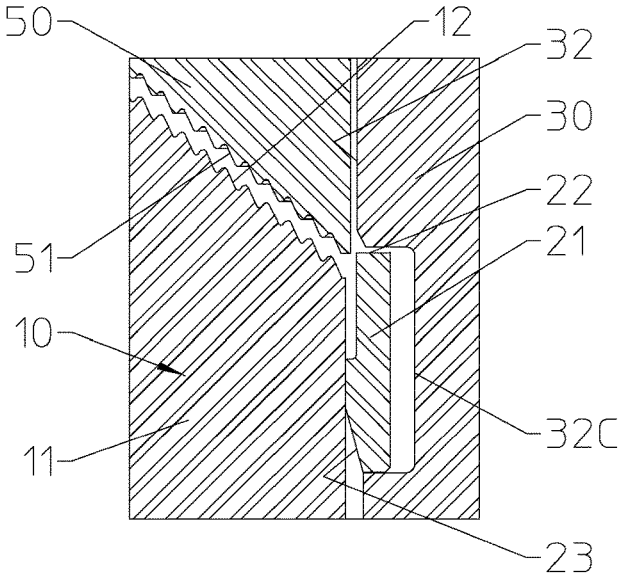
FIG. 1C is a close-up of the partial cutaway view of the wellhead system having the tubing hanger system of FIG. 1A, in accordance with an embodiment of the present disclosure.
Figure 2:
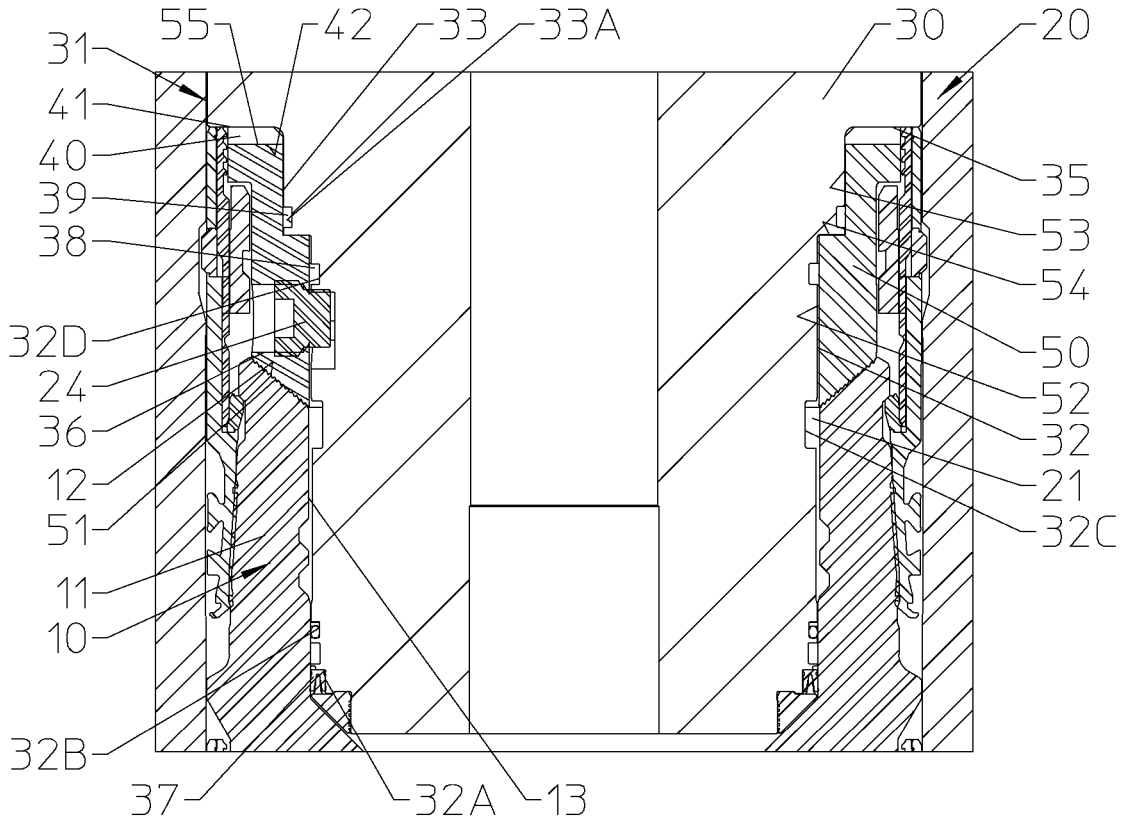
FIG. 2 is a partial cutaway view of the tubing hanger system of FIG. 1A, in accordance with an embodiment of the present disclosure.
Figure 3A:
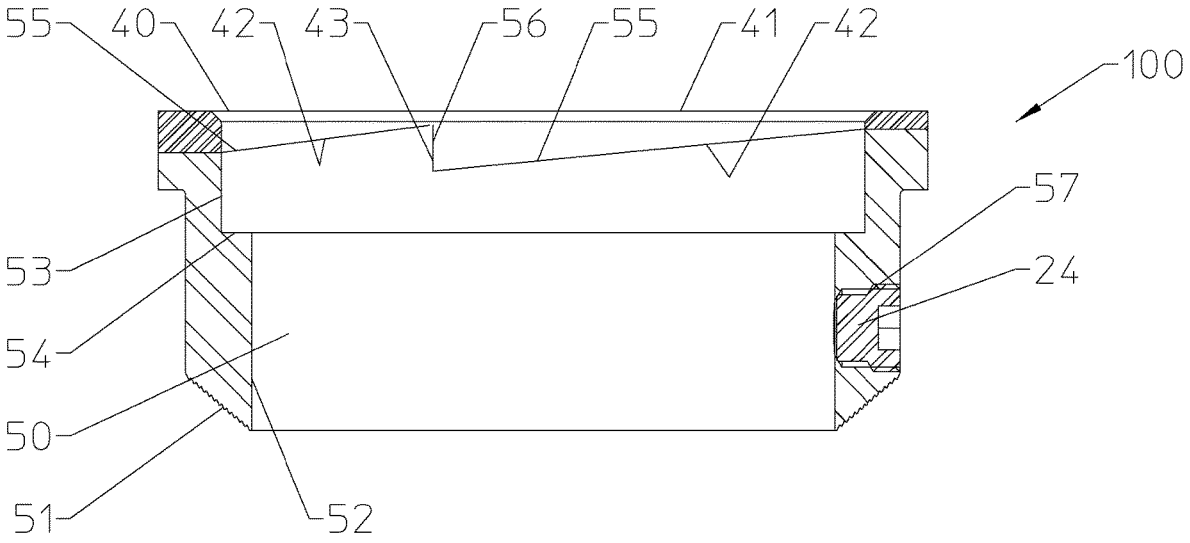
FIG. 3A is a cutaway view of a ramp ring and a piston of the tubing hanger system of FIG. 1A where the ramp ring is disposed in an initial position, in accordance with an embodiment of the present disclosure.
Figure 3B:
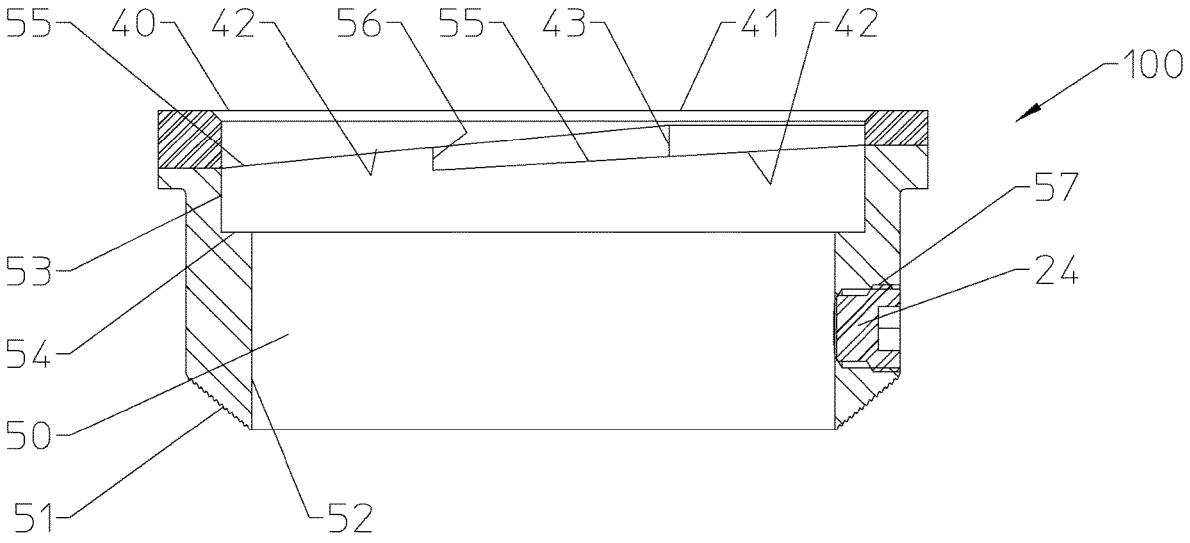
FIG. 3B is a cutaway view of a ramp ring and a piston of the tubing hanger system of FIG. 1A where the ramp ring is disposed in a rotated position, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments of the present disclosure may be directed to a tubing hanger system that may be installed within a wellhead system in a single trip. The tubing hanger system may include multiple pieces that are coupled together such that the tubing hanger may be locked to an inner wall of a high-pressure wellhead housing while applying a preload on a casing hanger, thereby rigidizing the tubing hanger system and casing hanger within the wellhead housing. The tubing hanger system may be run into the wellhead system until the tubing hanger system abuts the casing hanger. Then, the tubing hanger system may be picked up until the tubing hanger system is locked against an inner wall of the high-pressure housing. Lastly, a space-out mechanism of the tubing hanger system may actuate such that it takes up any gaps formed axially by being picked up, thus rigidizing the tubing hanger system and casing hanger within the wellhead housing. The installation process for the tubing hanger system may be accomplished entirely during a single trip into the wellhead as opposed to a first trip with a lead impression tool followed by an adjustment of the tubing hanger system at the surface and a subsequent trip downhole to install the adjusted tubing hanger system. The disclosed systems and method provide both time savings (since only one trip into the wellhead is necessary) and cost savings (since an additional lead impression tool is not required) compared to existing tubing hanger installation techniques.

Certain embodiments of the present disclosure may also be directed to a seal assembly having enhanced rigidity. The seal assembly may be configured such that fluid may apply pressure to the inner diameter of the seal assembly's lower body, thereby pushing the lower body down. When the lower body is pushed down, a pressure-actuated release mechanism (such as a shear pin) may be actuated (e.g., broken), allowing the lower body to descend further while a ramp ring and spring reduce the size of any existing gap between the casing hanger and wellhead. Such embodiments allow for enhanced rigidization of the wellhead system with minimal cost.

Referring now to FIGS. 1A-3B, certain components of a wellhead system 1 are illustrated according to one or more embodiments of the present disclosure. The illustrated wellhead system 1 may be a subsea wellhead assembly. However, similar techniques may be used in land-based wellhead systems as well. The wellhead system 1 may include a wellhead housing 2, a casing hanger 10, a tubing hanger system 20, and a locking mechanism 60. The casing hanger 10 may be landed within the wellhead housing 2. The tubing hanger system 20 may then be landed upon the casing hanger 10 within the wellhead housing 2. Lastly, the locking mechanism 60 may be landed upon the tubing hanger system 20 within the wellhead housing 2. The wellhead housing 2 may include a central bore 3 having locking profile 4 disposed thereon. The locking mechanism 60 may engage the locking profile 4 of the wellhead housing 2 in order to lock the casing hanger 10, the tubing hanger system 20, and the locking mechanism 60 in place within the wellhead housing 2 and rigidize the system.

The casing hanger 10 may include a casing hanger body 11 having an upper load shoulder 12 and a radially interior profile 13. The upper load shoulder 12 may be tapered inwards towards the interior profile 13 and ridges may be formed along the upper load shoulder 12. However, one of ordinary skill in the art would understand that in other embodiments, the upper load shoulder may be tapered outwards away from the interior profile or may not be tapered at all. Additionally, one of ordinary skill in the art would understand that in other embodiments, the upper load shoulder may be smooth or curved instead of having ridges.

The tubing hanger system 20 may include a tubing hanger body 30 and a space-out mechanism 100. In one or more embodiments, the space-out mechanism may include a ramp ring 40 and a piston 50. However, one of ordinary skill would understand that space-out mechanisms of other embodiments may include a plurality of ramp rings or wedges. The tubing hanger body 30, the ramp ring 40, and the piston 50 may be assembled together before being inserted into the wellhead housing 2 such that the tubing hanger system 20 may be installed in a single trip. The manner in which each of the parts in the tubing hanger system 20 are coupled will be discussed further below. Additionally, the tubing hanger system 20 may be run into the wellhead housing 2 and disposed such that the tubing hanger body 30 seals against the interior profile 13 of the casing hanger body 11 and the piston 50 abuts the upper load shoulder 12 of the casing hanger 10. In one or more embodiments, to ensure that tubing hanger system 20 is properly seated on the casing hanger 10, one or more safety lock mechanisms may be used. The safety lock mechanisms according to one or more embodiments of the present disclosure will be discussed further below.

Still referring to FIGS. 1A-3B, the tubing hanger body 30, according to one or more embodiments of the present disclosure, may include a radially exterior profile 31 defined, in part, by a first sealing profile 32, a second sealing profile 33, an upward facing contact surface 34, a downward facing contact surface 35, and an axially extending pin slot 36. The first sealing profile 32 may include a first seal groove 32*a* in which a tubing hanger to casing hanger seal 37 is disposed, a second seal groove 32*b* in which an o-ring may be disposed, a third groove 32*c* in which a retainer ring 21 may be disposed, and a fourth seal groove 32*d* in which a first tubing hanger to piston seal 38 may be disposed. The second sealing profile 33 may include groove 33*a* in which a second tubing hanger to piston seal 39 may be disposed.

Further, the ramp ring 40 of the space-out mechanism 100, according to one or more embodiments of the present disclosure, may include an upper contact surface 41, ramp surfaces 42, and rotational stop surfaces 43. The ramp ring 40 may be disposed adjacent to the tubing hanger body 30 such that the ramp ring 40 is positioned about the second sealing surface 33 of the tubing hanger body 30 and, at least when the tubing hanger system 20 is run-in and when the tubing hanger system 20 is in a fully locked position, the upper contact surface 41 may contact the downward facing contact surface 35 of the tubing hanger body 30. Additionally, in one or more embodiments, a bottom of the ramp ring 40 may have a plurality of ramp surfaces 42 and a plurality of rotational stop surfaces 43. By way of example, in one or more embodiments, the ramp ring 40 may include three ramp surfaces each extending 120° circumferentially about the ramp ring 40. However, one of ordinary skill in the art will understand that in other embodiments, the ramp ring may have a single ramp surface and a single rotational stop surface or any combination of equal numbers of ramp surfaces and rotational stop surfaces that match the number of ramp surfaces and rotational stop surfaces of the piston. Further, in one or more embodiments of the present disclosure, the ramp surfaces 42 may have a constant 3.5° taper. However, one of ordinary skill in the art will understand that in other embodiments the ramp surface may include steps or ridges and/or may have a constant or changing taper in the range of 0.5°-7°. Alternatively, the ramp surface may include any range of angles, surface geometries, and/or coatings that prevent rotation once installed.

Additionally, the piston 50 of the space-out mechanism 100 may include a lower load shoulder 51, a first interior seal surface 52, a second interior seal surface 53, an interior shoulder 54, ramp surfaces 55, rotational stop surfaces 56, and a threaded pin borehole 57. The piston 50 may be disposed adjacent to the casing hanger 10, the tubing hanger body 30, and the ramp ring 40 such that piston is positioned about the first sealing surface 32 and the second sealing surface 33 of the tubing hanger body 30. Further, the piston 50 may abut the casing hanger 20 on one side and the ramp ring 40 on the other side. Thus, in one or more embodiments, the lower load shoulder 51 may abut the upper load shoulder 12 of the casing hanger 10. As such, the lower load shoulder 51 may be tapered to match the taper of the upper load shoulder 12 of the casing hanger 10 and ridges may be formed along the lower load shoulder 51 to match the ridges of the upper load shoulder 12 of the casing hanger 10. However, as discussed above with regard to the upper load shoulder 12 of the casing hanger 10, one of ordinary skill in the art would understand that in other embodiments, the lower load shoulder may be tapered in a number of ways as long as the taper of the lower load shoulder matches the taper of the upper load shoulder. Additionally, one of ordinary skill in the art would understand that in other embodiments, the upper load shoulder may be smooth or curved instead of having ridges.

Further, the first interior seal surface 52 and second interior seal surface 53 of the piston 50 may be disposed such that when the tubing hanger system 20 is fully assembled, the first tubing hanger to piston seal 38 and the second tubing hanger to piston seal 39 may seal against the first interior seal surface 52 and the second interior seal surface 53 of the piston 50, respectively. Furthermore, when the tubing hanger system 20 is disposed within the wellhead housing 2 and landed on the casing hanger 10, the first sealing profile 32 of the tubing hanger body 30 may sit within the casing hanger 10 such that the tubing hanger to casing hanger seal 37 seals against the interior profile 13 of the casing hanger 10. This sealing profile created between the casing hanger 10, the tubing hanger body 30, and the piston 50 may create a piston force that acts in a downward direction against the interior shoulder 54 of the piston 50, which may hold the piston 50 in abutment with the casing hanger 10 in the event that the tubing hanger body 30 is shifted in an upward direction. Additionally, in one or more embodiments, the threaded pin borehole 57 of the piston 50 may be aligned with the pin slot 36 of the tubing hanger body 30, and an anti-rotation pin 24 may be coupled to the threaded pin borehole 57 such that the anti-rotation pin 24 rests within the pin slot 36. This anti-rotation pin, according to one or more embodiments of the present disclosure, may rotationally couple the piston to the tubing hanger body 30 such that the ramp ring 40 may rotate relative to the piston 50 while allowing the tubing hanger body 30 to move axially relative to the piston 50 so that any gap that is formed in locking the tubing hanger system 20 and casing hanger 10 to the wellhead housing 2 may be filled. However, one of ordinary skill in the art would understand that in other embodiments a variety of methods may be used to rotationally secure the piston and the tubing hanger body such that the ramp ring may rotate relative to the tubing hanger body without also rotating the piston.

Furthermore, still referring to FIGS. 1A-3B, the ramp surfaces 55 of the piston 50 may be configured to abut the ramp surfaces 42 of the ramp ring 40 at least when the tubing hanger system 20 is run-in and when the tubing hanger system 20 is in a fully locked position. As discussed above with regard to the ramp surfaces 42 of the ramp ring 40, the ramp surfaces 55 of the piston 50 may be designed in various ways so long as the ramp surfaces 55 match the ramp surfaces 42. By way of example, in one or more embodiments, the piston may include three ramp surfaces each extending 120° circumferentially about the piston 50. However, one of ordinary skill in the art will understand that in other embodiments, the piston may have a single ramp surface and a single rotational stop surface or any combination of equal numbers of ramp surfaces and rotational stop surfaces that match the number of ramp surfaces and rotational stop surfaces of the ramp ring. Further, in one or more embodiments of the present disclosure, the ramp surfaces 55 may have a constant 3.5° taper. However, one of ordinary skill in the art will understand that in other embodiments the ramp surface may include steps or ridges and/or may have a constant or changing taper in the range of 0.5°-7°. One of ordinary skill will appreciate that the ramp surfaces are designed such that the contact between the ramp surfaces is self-locking and compressive forces between the surfaces will not cause the piston and ramp ring to rotate relative to each other once the tubing hanger system is in the fully locked position. Further, the rotational stop surfaces 56 of the piston 50 and the rotational stop surfaces 43 of the ramp ring 40 may be configured to abut each other at least when the tubing hanger system 20 is run in and may prevent the piston and ramp ring from rotating relative to each other in one direction.

Additionally, the locking mechanism 60, according to one or more embodiments of the present disclosure, may include a locking mandrel 61 and locking dogs 62. The plurality of locking dogs 62 may be supported around the locking mandrel 61. The locking mechanism 60 may be run into the wellhead housing 2 until the locking mechanism 60 abuts the upward facing contact surface 34 of the tubing hanger body 30. In one or more embodiments, a bottom surface of the locking dogs 62 may directly abut the upward facing contact surface 34 and may be pushed outward into the locking profile 4 of the wellhead housing 2 by a compressive force caused by the locking mandrel 61 pushing down on the locking dogs 62. The locking dogs 62 may have ridges disposed on an outer surface that match the locking profile 4 disposed along the central bore 3 of the wellhead housing 2.

Further, the tubing hanger system 20 may include one or more safety locks to ensure that the system is properly run into the wellhead housing 2 and features of the system are not activated prematurely. By way of example, in one or more embodiments, a retainer ring 21 may be included in the tubing hanger system 20 so as to make sure that the piston 50 is properly seated upon the casing hanger 10 and the seals of the tubing hanger body 30 are set within the piston 50 and the casing hanger 10 as necessary for the system to function properly. The retainer ring 21 may be a split ring disposed within the third groove 32*c* of the tubing hanger body 30 and may have an uncollapsed outer diameter that is greater than both the diameter of the interior profile 13 of the casing housing 10 and the first interior seal surface 52 of the piston 50. Further, in a pre-run-in assembled state, the third groove 32*c* and the retainer ring 21 may be disposed below the lower load shoulder 51 of the piston 50. This disposition of the retainer ring 21 and third groove 32*c* may be such that the lower load shoulder 51 of the piston 50 cannot abut the upper load shoulder 12 of the casing hanger 10 until the retainer ring 21 is collapsed into the third groove 32*c*. The retainer ring 21 may include an upper contact surface 22 and a lower contact surface 23. The lower contact surface 23 may be tapered such that downward forces from the piston 50 and/or tubing hanger body 30 during run-in push the tapered lower contact surface 23 into an interior edge of the upper load shoulder 12 of the casing hanger 10 and cause the retainer ring 21 to collapse into the third groove 32*c*. Once collapsed, the outer diameter of the retainer ring 21 may be smaller than the interior profile 13 of the casing hanger 10, allowing the tubing hanger system 20 to properly seat within and against the casing hanger 10. Thus, in one or more embodiments, the retainer ring 21 needs to be collapsed in order for the lower load shoulder 51 of the piston 50 to be able to abut the upper load shoulder 12 of the casing hanger 10. Additionally, various other safety locks may be used in one or more embodiments of the present disclosure.

Figure 4:
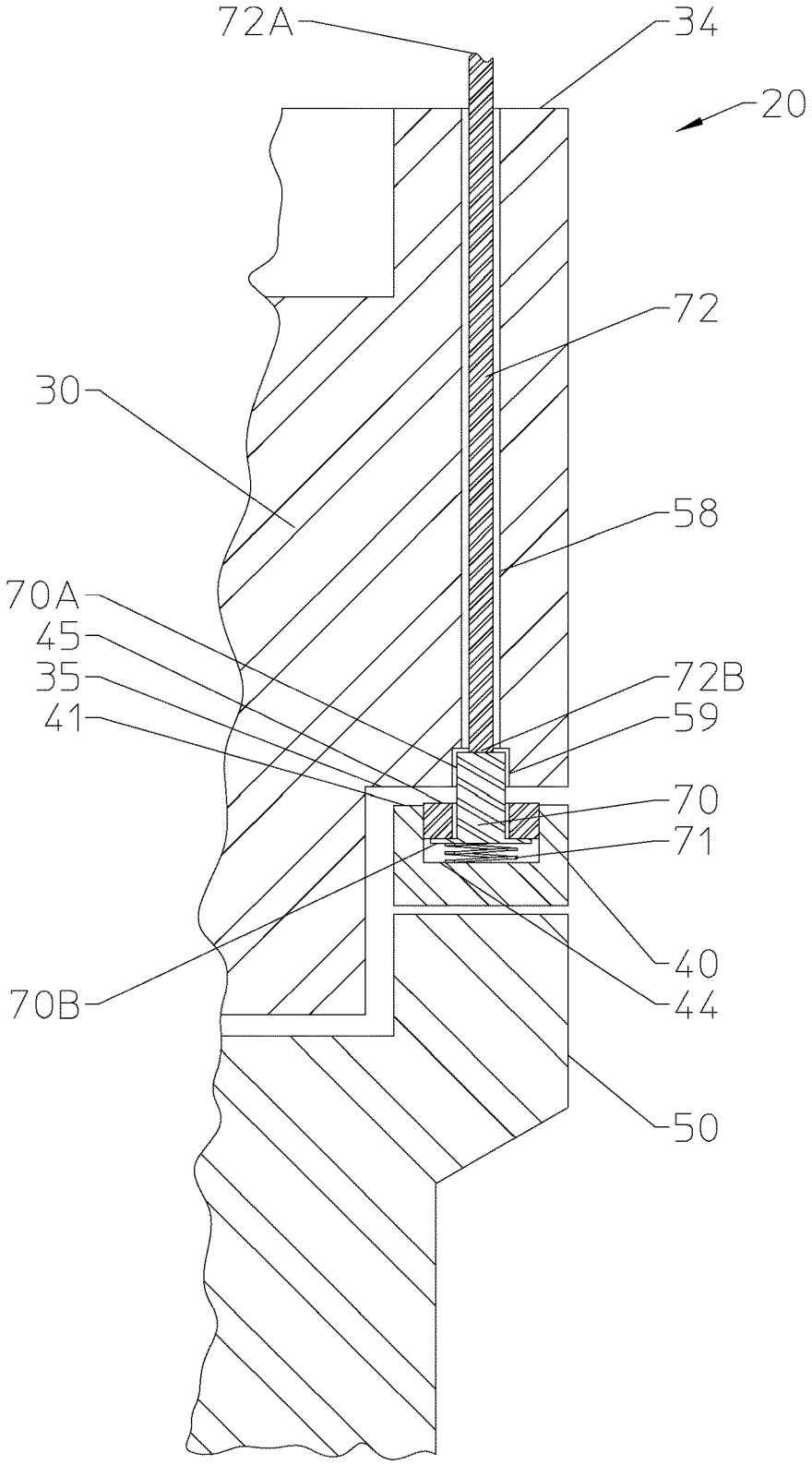
FIG. 4 is a partial cross-sectional view of the wellhead system having the tubing hanger system of FIG. 1A, in accordance with an embodiment of the present disclosure.

Referring now to FIG. 4, another safety mechanism according to one or more embodiments of the present disclosure is illustrated. A spring loaded pin disposed within the ramp ring 40 may be installed during assembly of the tubing hanger system 20 and engage the tubing hanger body 30 so as to rotationally lock the ramp ring to the tubing hanger body until the proper time in the tubing hanger system run-in in which the ramp ring must be rotationally actuated in order to take up any axial space created by the installation procedure.

The safety mechanism of the tubing hanger system 20 may include a safety lock pin 70, a safety lock spring 71, and a safety lock rod 72. The safety lock pin 70 and the safety lock spring 71 may be disposed within the ramp ring 40, and the safety lock rod 72 may be disposed within the tubing hanger body 30. The ramp ring 40, in one or more embodiments, may include a pin blind hole 44 disposed in an upper contact surface 41 and a pin securing mechanism 45. The safety lock spring 71 may be disposed within the pin blind hole 44 abutting a bottom of the blind hole, and the safety lock 70 pin may be disposed above the safety lock spring 71 in the blind hole such that the safety lock pin 70 is pushed up towards the tubing hanger body 30. The safety lock pin 70 may include a safety lock pin body 70*a* and a safety lock pin flange 70*b*, in which the diameter of the safety lock pin flange 70*b* is greater than the diameter of the safety lock pin body 70*a*. The pin securing mechanism 45 may be disposed in the opening of the pin blind hole 44 and may have an inner diameter larger than the safety lock pin body 70*a* but smaller than the diameter of the safety lock pin flange 70*b* such that the safety lock pin 70 is maintained within the pin blind hole 44 while the safety lock pin body 70*a* is able to extend past the upper contact surface 41 of the ramp ring 40.

Additionally, the tubing hanger body 30, in one or more embodiments, may include an elongated hole 58 that extends from an upward facing contact surface 34 to a downward facing contact surface 35. Further, a pin counterbore 59 may be sunk into the downward facing contact surface 35 and concentric with the hole 58. An inner diameter of the pin counterbore 59 may be slightly larger than the outer diameter of the safety lock pin body 70*a*, and the pin counterbore 59 may be configured to receive the safety lock pin 70 when the tubing hanger system 20 is assembled before run-in. Further, the safety lock rod 72 may be disposed within the hole 58. The safety lock rod 72 may be longer than the length of the hole 58 and the pin counterbore 59 such that when the safety lock pin 70 extends into the pin counterbore 59, the top end 72*a* of the safety lock rod 72 extends above the upward facing contact surface 34 and when the safety lock rod 72 is compressed down to the upward facing contact surface 34 into the hole 58, the bottom end 72*b* of the safety lock rod 72 is even with or extends slightly below the downward facing contact surface 35.

Further referring to FIG. 4, in one or more embodiments of the present disclosure, when the tubing hanger system 20 is assembled before run-in, the safety lock pin 70 may engage the pin counterbore 59. During the installation of the tubing hanger system 20 within a wellhead housing, installation of a locking mechanism may cause a locking mandrel to compress the safety lock rod 72 into the hole 58, which will cause the bottom end 72*b* of the safety lock rod 72 to push the safety lock pin 70 out of the pin counterbore 59. Once the safety lock pin 70 is removed from the pin counterbore 59, the tubing hanger body 30 and the ramp ring 40 will no longer be rotationally locked with respect to each other allowing the ramp ring 40 to rotate relative to the piston 50 along their respective ramp surfaces in order to remove any axial gaps in the tubing hanger system 20 created during the process of locking the tubing hanger system within the wellhead housing.

Figure 5A:
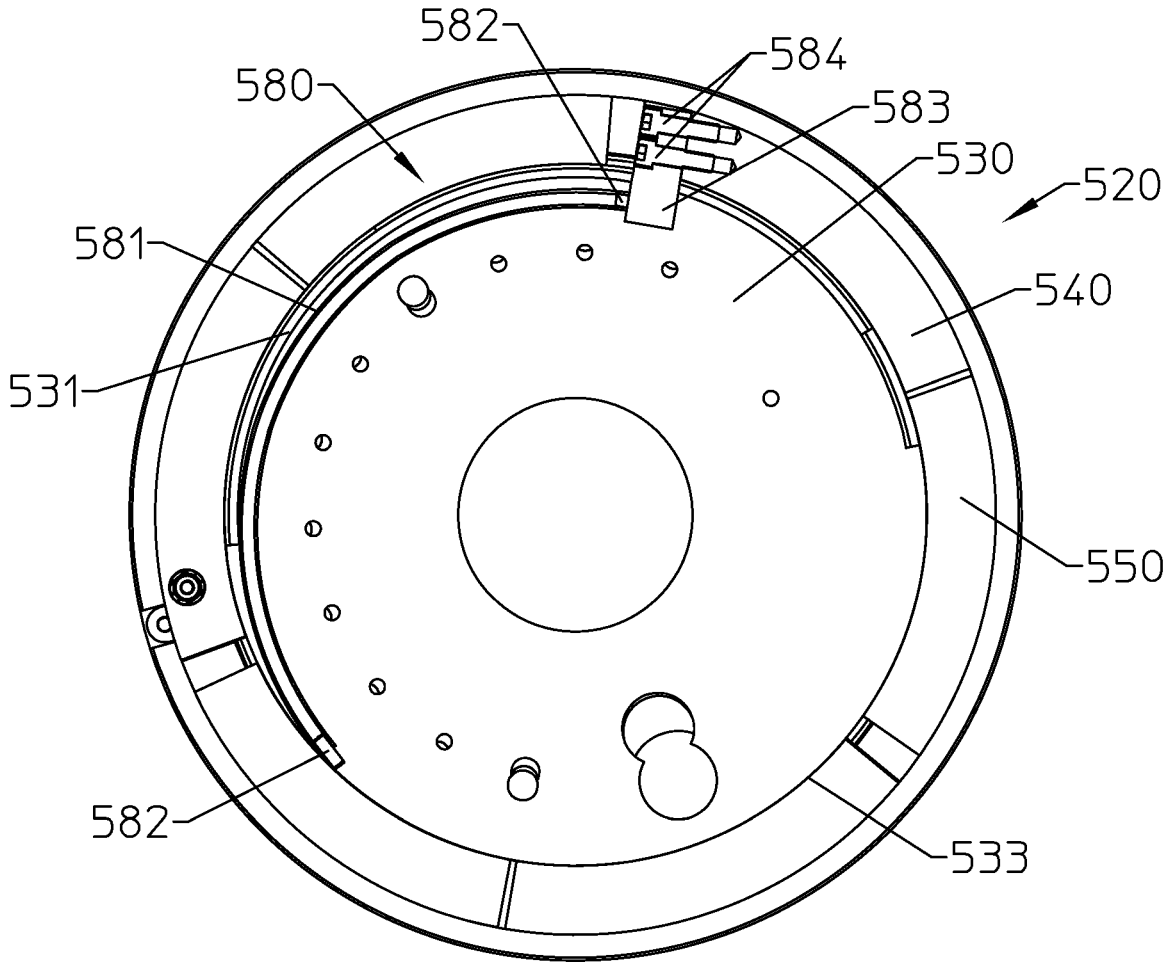
FIG. 5A is a top-down cross-sectional view of a tubing hanger system, in accordance with an embodiment of the present disclosure.
Figure 5B:
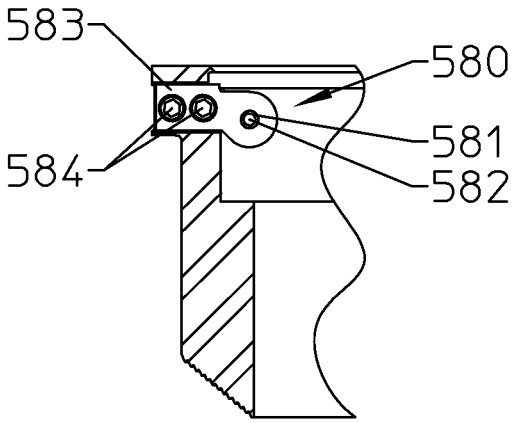
FIG. 5B is a partial perspective view of the tubing hanger system of FIG. 5A, in accordance with an embodiment of the present disclosure.

Referring now to FIGS. 5A and 5B, a tubing hanger system 520, according to one or more embodiments of the present disclosure, is illustrated. As discussed previously, the tubing hanger system 520 may include a tubing hanger body 530 and a space-out mechanism 500. Further, the space-out mechanism 500 may include a ramp ring 540 and a piston 550. Additionally, in one or more embodiments, the ramp ring 540 of the space-out mechanism 500 may be rotationally coupled to the tubing hanger body 530 by a circumferential spring mechanism 580. The circumferential spring mechanism 580 may be coupled to the ramp ring 540 on a first end and to the tubing hanger body 530 on a second end. The circumferential spring mechanism 580 may include a spring 581, spring connectors 582, a transfer block 583, and bolts 584. The spring 581 may be disposed within a circumferential groove 531 located on the second sealing profile 533 of the tubing hanger body 530. The circumferential groove 531 may be disposed between the downward facing contact surface (not shown) of the tubing hanger body 530 and the fourth seal groove (not shown), which is disposed on the second sealing profile 533 of the tubing hanger body 530. Further, the spring 581 may be directly coupled to the tubing hanger body 530 by a spring connector 582 on a first end of the circumferential groove 531 and may be directly coupled to the transfer block 583 by a spring connector 582 within a distal portion of the circumferential groove 531. The transfer block 583 may be directly coupled to the ramp ring 540 by bolts 584.

In one or more embodiments, when assembling the tubing hanger system 520 before run-in, the circumferential spring mechanism 580 may be preloaded such that when a safety mechanism rotationally locking the tubing hanger body 530 and the ramp ring 540 is disengaged, the space-out mechanism 500 self-actuates to rotate the ramp ring 540 against the piston 550 to extend the space-out mechanism 500 axially and remove any axial gaps that have formed during installation of the tubing hanger system 520 into wellhead housing. When the space-out mechanism 500 is actuated, the rotation of the ramp ring will cause the ramp surface of the ramp ring 540 to bear against and rotate against the ramp surface of the piston 530 and extend the space-out mechanism 500 axially.

By way of example, in one or more embodiments, the space-out mechanism 500 may be configured such that the preload puts the spring 581 in tension and releasing the safety mechanism causes the spring 581 to pull the ramp ring 540 causing it to rotate against the piston 550. However, one of ordinary skill would appreciate that in other embodiments, the spring 581 may be preloaded in compression such that releasing the safety mechanism causes the spring to push the ramp ring 540 causing it to rotate against the piston 550. Additionally, while a single preloaded spring 581 is illustrated in FIGS. 5A and 5B, one of ordinary skill would appreciate that in other embodiments, there may be multiple springs situated in series or in parallel and preloaded in tension, compression, or torsion so as to rotate a ramp surface of the ramp ring 540 against a ramp surface of the piston 550 causing the space-out mechanism to extend axially and fill in any axial gaps created while rigidizing the tubing hanger system and casing hanger within the wellhead housing.

Figure 6A:
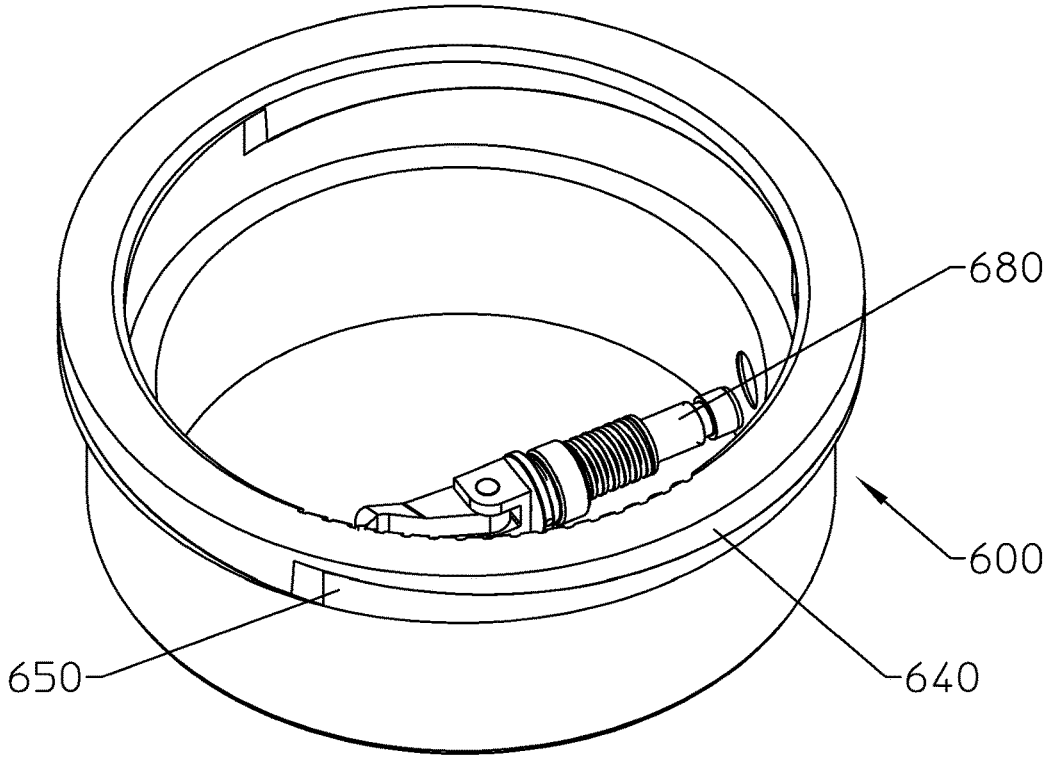
FIG. 6A is an isometric view of a tubing hanger system, in accordance with an embodiment of the present disclosure.
Figure 6B:
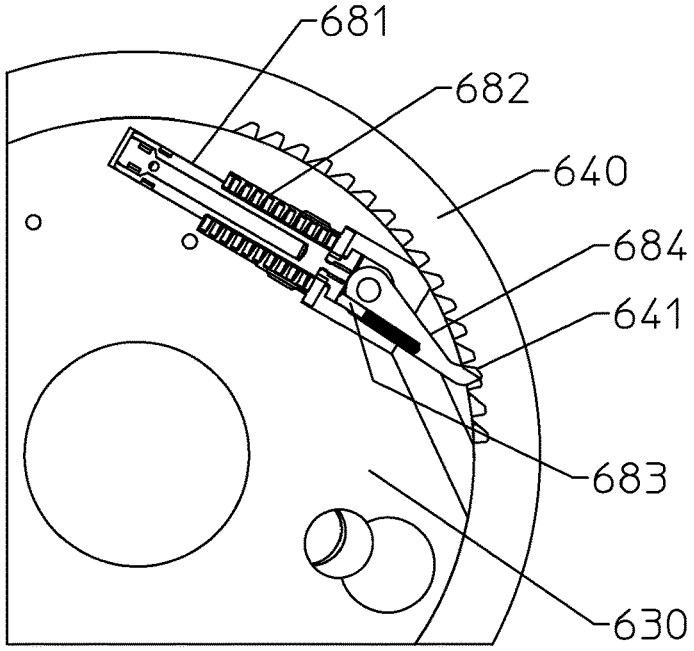
FIG. 6B is a partial top-down cross-sectional view of the tubing hanger system of FIG. 6A, in accordance with an embodiment of the present disclosure.

Referring now to FIGS. 6A and 6B, a tubing hanger system 620, according to one or more embodiments of the present disclosure, is illustrated. As discussed previously, the tubing hanger system 620 may include a tubing hanger body 630 and a space-out mechanism 600. Further, the space-out mechanism 600 may include a ramp ring 640 and a piston 650. Additionally, in one or more embodiments, the space-out mechanism may include a ratchet mechanism 680 disposed inside the tubing hanger system 620 that is configured to allow a user to remotely rotate the ramp ring 640 as necessary during run-in and the process of rigidizing the tubing hanger system 620 within the wellhead housing. The ramp ring 640 may include a plurality of inclined grooves 641 disposed circumferentially along its inner diameter. The ratchet mechanism 680 may be configured to engage the grooves 641 of the ramp ring 640 such that each stroke of the ratchet mechanism rotates the ramp ring 640 by the radial distance of a single groove. The ratchet mechanism 680, according to one or more embodiments of the present disclosure, may be a short stroke piston with a ratchet. The ratchet mechanism 680 may include a piston 681, a spring 682, an actuation arm 683, and a lever 684. The piston 681 and the spring 682 may be coaxially disposed with one end of the actuation arm 683 coupled to one end of the piston 681. Further, the other end of the actuation arm may be coupled to the lever 684, which is itself pinned to a non-moving portion of the piston 681, in order to force the lever 684 to rotate about the pinned connection. The piston 681 may be remotely controlled by a user so as to actuate the ratchet mechanism 680 by pulling the actuation arm 683 such that the lever 684 rotates out of the groove it is sitting in and then allowing the lever 684 to rotate back against the edge of a groove under the force of the spring 682, which causes the actuation arm to return the lever to its resting position, such that the lever 684 now engages an adjacent groove; thus, rotating the ramp ring 640, accordingly. Further, as discussed above, rotating the ramp ring 640 causes the ramp ring 640 to shift against the piston 650 to extend the space-out mechanism 600 axially and remove any axial gaps that have formed during installation of the tubing hanger system 620 into the wellhead housing. When the space-out mechanism 600 is actuated, the rotation of the ramp ring will cause the ramp surface of the ramp ring 640 to bear against and rotate against the ramp surface of the piston 630 and extend the space-out mechanism 600 axially.

Figure 7:
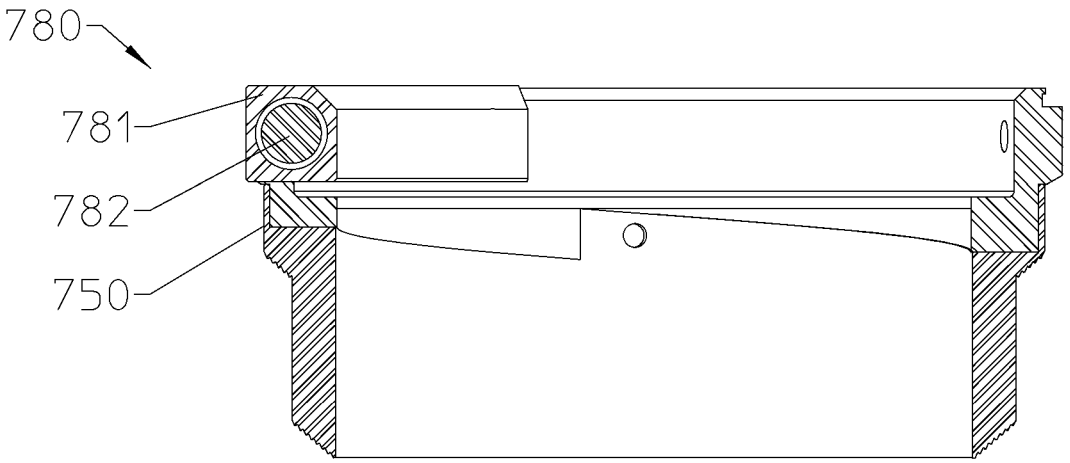
FIG. 7 is an isometric view of a ramp ring rotating mechanism, in accordance with an embodiment of the present disclosure.

Referring now to FIG. 7, a ramp ring rotating mechanism 780, according to one or more embodiments of the present disclosure, is illustrated. A space-out mechanism may include the ramp ring rotating mechanism 780 coupled to a ramp ring. The ramp ring rotating mechanism 780 may include a piston 781 and a curved piston rod 782. In one or more embodiments, the curved piston rod 782 may be 3-D printed. Further, the curved piston rod 782 may be disposed within the piston 781 and extend from the piston 781. An end of the curved piston rod 782 may be coupled to the ramp ring, and actuating the piston 781 may cause the curved piston rod 782 to extend, thus causing the ramp ring to rotate relative to a tubing hanger body and a piston 750 of a tubing hanger system. Further, as discussed above, rotating the ramp ring may cause the ramp ring to shift against the piston 750 to extend the space-out mechanism axially and remove any axial gaps that have formed during installation of the tubing hanger system into a wellhead housing. When the space-out mechanism is actuated, the rotation of the ramp ring may cause the ramp surface of the ramp ring to bear against and rotate against the ramp surface of the piston 750 and extend the space-out mechanism axially.

Figure 8A:
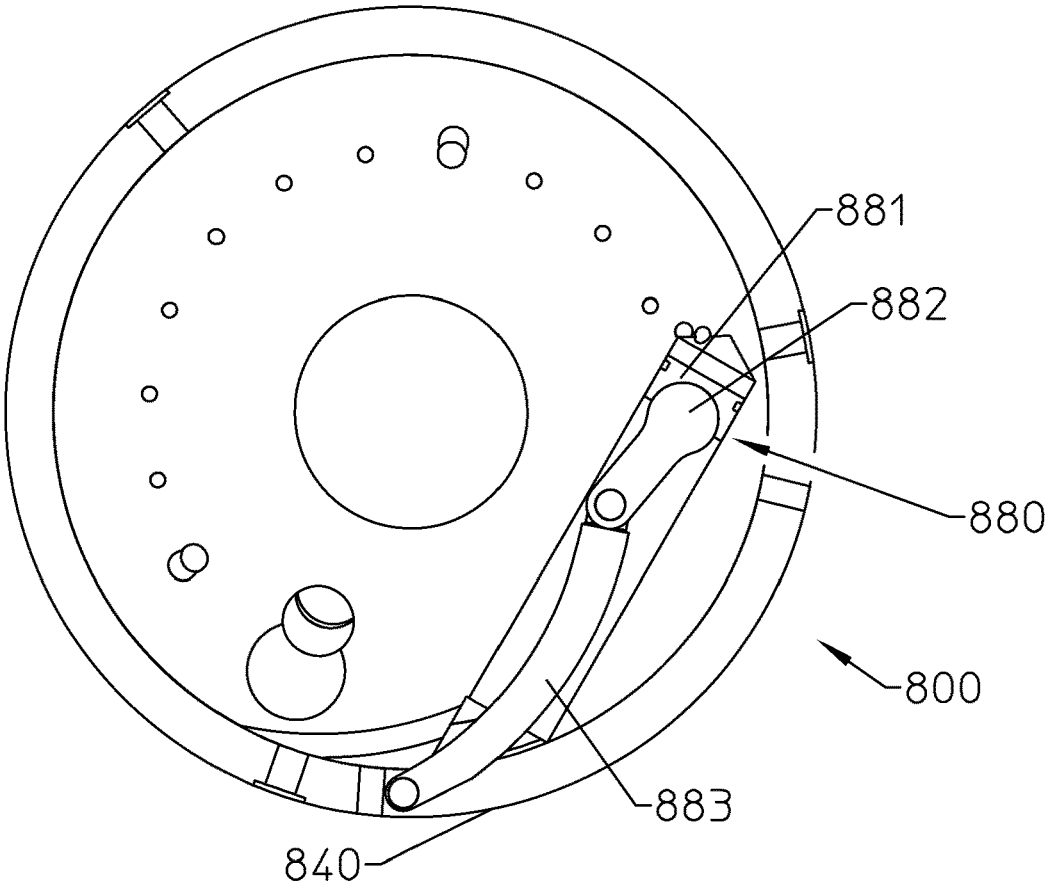
FIG. 8A is an isometric view of a ramp ring rotating mechanism, in accordance with an embodiment of the present disclosure.
Figure 8B:
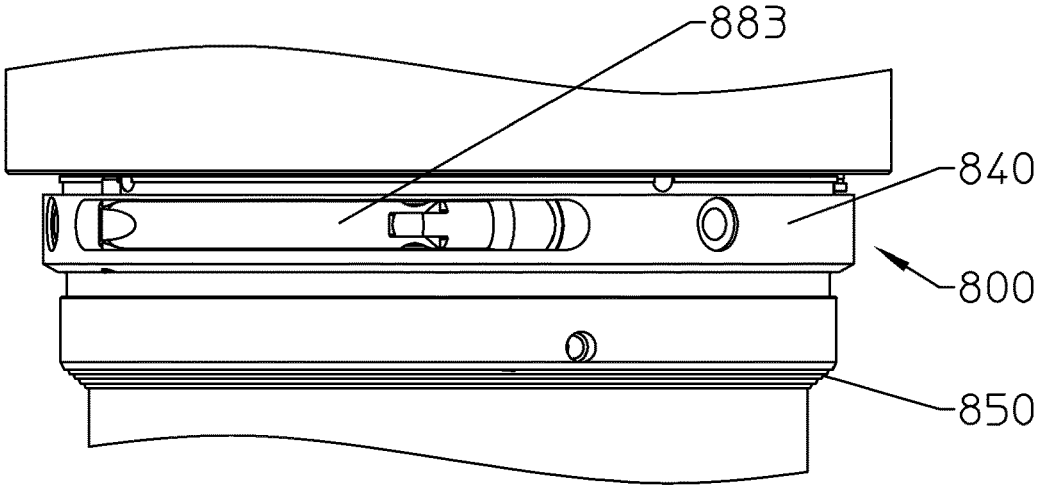
FIG. 8B is a partial perspective view of the ramp ring rotating mechanism of FIG. 8A, in accordance with an embodiment of the present disclosure.

Referring now to FIGS. 8A and 8B, a ramp ring rotating mechanism 880, according to one or more embodiments of the present disclosure, is illustrated. A space-out mechanism 800 may include the ramp ring rotating mechanism 880 coupled to a ramp ring 840. The ramp ring rotating mechanism 880 may include a piston 881, an arm 882, and a slider 883. In one or more embodiments, the arm 882 may be coupled to the piston 881 and may be rotated by way of actuation of the piston 881, which may be operated remotely by a user. An end of the arm 882 may be coupled to a first end of the slider 883, and a second end of the slider 883 may be coupled to the ramp ring 840. In one or more embodiments, the slider 883 may be coupled to the arm 882 and the ramp ring 840 by pins. Further, actuating the piston 881 may cause the arm 882 to rotate, thus causing the slider 883 to rotate about the pinned connection to the arm 882 and rotating the ramp ring 840 relative to a tubing hanger body and a piston 850 of a tubing hanger system. Further, as discussed above, rotating the ramp ring 840 may cause the ramp ring 840 to shift against the piston 850 to extend the space-out mechanism 800 axially and remove any axial gaps that have formed during installation of the tubing hanger system into a wellhead housing. When the space-out mechanism 800 is actuated, the rotation of the ramp ring 840 may cause the ramp surface of the ramp ring 840 to bear against and rotate against the ramp surface of the piston 850 and extend the space-out mechanism 800 axially.

Figure 9A:
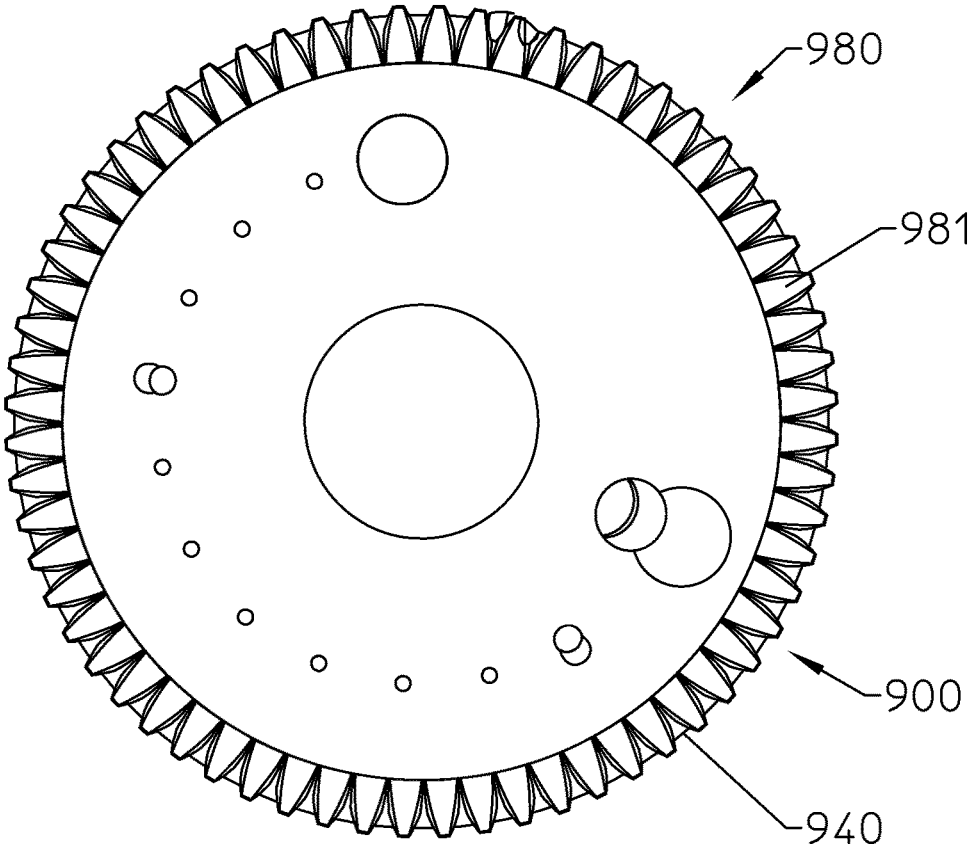
FIG. 9A is an isometric view of a ramp ring rotating mechanism, in accordance with an embodiment of the present disclosure.
Figure 9B:
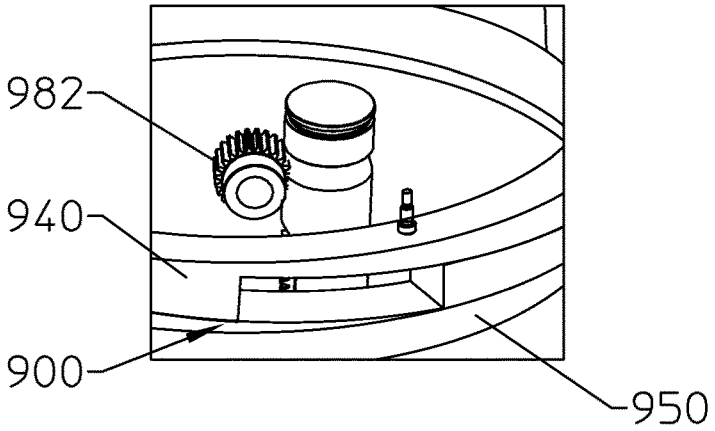
FIG. 9B is a partial perspective view of the ramp ring rotating mechanism of FIG. 9A, in accordance with an embodiment of the present disclosure.

Referring now to FIGS. 9A and 9B, a ramp ring rotating mechanism 980, according to one or more embodiments of the present disclosure, is illustrated. A space-out mechanism 900 may include the ramp ring rotating mechanism 980 coupled to a ramp ring 940. The ramp ring rotating mechanism 980 may be a geared mechanism and may include a curved rack 981 and a pinion 982. In one or more embodiments, the curved rack 981 may be coupled to a ramp ring 940 and the pinion 982. Further, rotation of the pinion 982 may cause rotation of the ramp ring 940 by way of the curved rack 981, and the pinion 982 may be rotated by remote operation by a user. Therefore, in one or more embodiments, rotation of the pinion 982 may cause the ramp ring 940 to rotate relative to a tubing hanger body and a piston 950 of a tubing hanger system. Further, as discussed above, rotating the ramp ring 940 may cause the ramp ring 940 to shift against the piston 950 to extend the space-out mechanism 900 axially and remove any axial gaps that have formed during installation of the tubing hanger system into a wellhead housing. When the space-out mechanism 900 is actuated, the rotation of the ramp ring 940 may cause the ramp surface of the ramp ring 940 to bear against and rotate against the ramp surface of the piston 950 and extend the space-out mechanism 900 axially.

Figure 10:
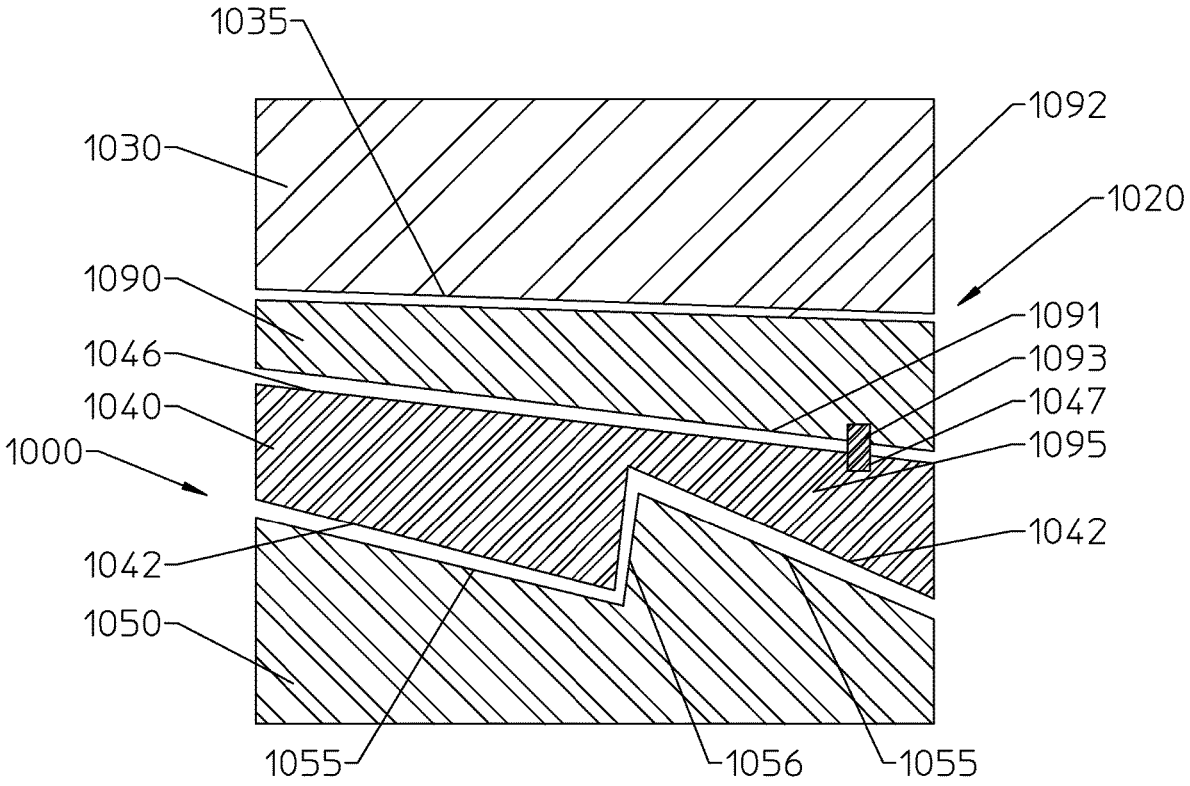
FIG. 10 is a partial cutaway view of a tubing hanger system, in accordance with an embodiment of the present disclosure.

Referring now to FIG. 10, a partial cutaway view of a tubing hanger system 1020, according to one or more embodiments of the present disclosure, is illustrated. The tubing hanger system 1020 may include a tubing hanger body 1030 and a space-out mechanism 1000. The space-out mechanism 1000 may include a first ramp ring 1040, a second ramp ring 1090, and a piston 1050. The piston 1050 may include ramp surfaces 1055 and rotational stop surfaces 1056.

Further, the first ramp ring 1040 may include lower ramp surfaces 1042 and an upper ramp surface 1046. The lower ramp surfaces 1042 may contact the ramp surfaces 1055 of the piston 1050, and in one or more embodiments, the ramp surfaces 1042 of the ramp ring 1040 and the ramp surfaces 1055 of the piston 1050 may match in number and taper. By way of example, in one or more embodiments, the ramp ring 1040 may include multiple ramp surfaces 1042 each extending 120° circumferentially about the ramp ring 1040. However, one of ordinary skill in the art will understand that in other embodiments, the ramp ring may have a single ramp surface and a single rotational stop surface or any combination of equal numbers of ramp surfaces and rotational stop surfaces that match the number of ramp surfaces and rotational stop surfaces of the piston. Further, in one or more embodiments of the present disclosure, the ramp surfaces 1042, 1055 may all have a constant 4° taper. However, one of ordinary skill in the art will understand that in other embodiments the ramp surface may include steps or ridges and/or may have a constant or changing taper in the range of 0.5°-7°. Additionally, the upper ramp surface 1046 of the first ramp ring 1040 may have a constant taper. In one or more embodiments, the upper ramp surface 1046 may have a constant taper of 0.5°. However, one of ordinary skill in the art will understand that in other embodiments the ramp surface may include steps or ridges and/or may have a constant or changing taper in the range of 0.5°-7°. Further, a pin blind hole 1047 may be formed on the upper ramp surface 1046.

Furthermore, the second ramp ring 1090 may include a lower ramp surface 1091 and an upper contact surface 1092. The lower ramp surface 1091 of the second ramp ring 1090 may contact and may match the taper of the upper ramp surface 1046 of the first ramp ring 1040. As discussed above, the lower ramp surface 1091 may have a constant taper of 0.5°. However, one of ordinary skill in the art will understand that in other embodiments the lower ramp surface 1091 may include steps or ridges and/or may have a constant or changing taper in the range of 0.5°-7° that matches that of the upper ramp surface 1046 of the first ramp ring 1040. Further, a pin blind hole 1093 may be formed on the lower ramp surface 1091 and may be coaxially aligned with the pin blind hole 1047 of the first ramp ring 1040 during assembly. Further, a shear pin 1095 may be disposed within the aligned pin blind holes 1047, 1093 to rotationally lock the first ramp ring 1040 and the second ramp ring 1090 until a sufficient piston force is applied to either the first ramp ring 1040 or the second ramp ring 1090 to shear the shear pin 1095 when locking and rigidizing the tubing hanger system 1020 within a wellhead housing.

Additionally, the tubing hanger body 1030 may include a downward facing contact surface 1035. The downward facing contact surface 1035 of the tubing hanger body 1030 may contact upper contact surface 1092 of the second ramp ring 1090 at least when the tubing hanger system 1020 is run-in and when the tubing hanger system 1020 is in a fully locked and rigidized position within the wellhead housing.

Figure 11:
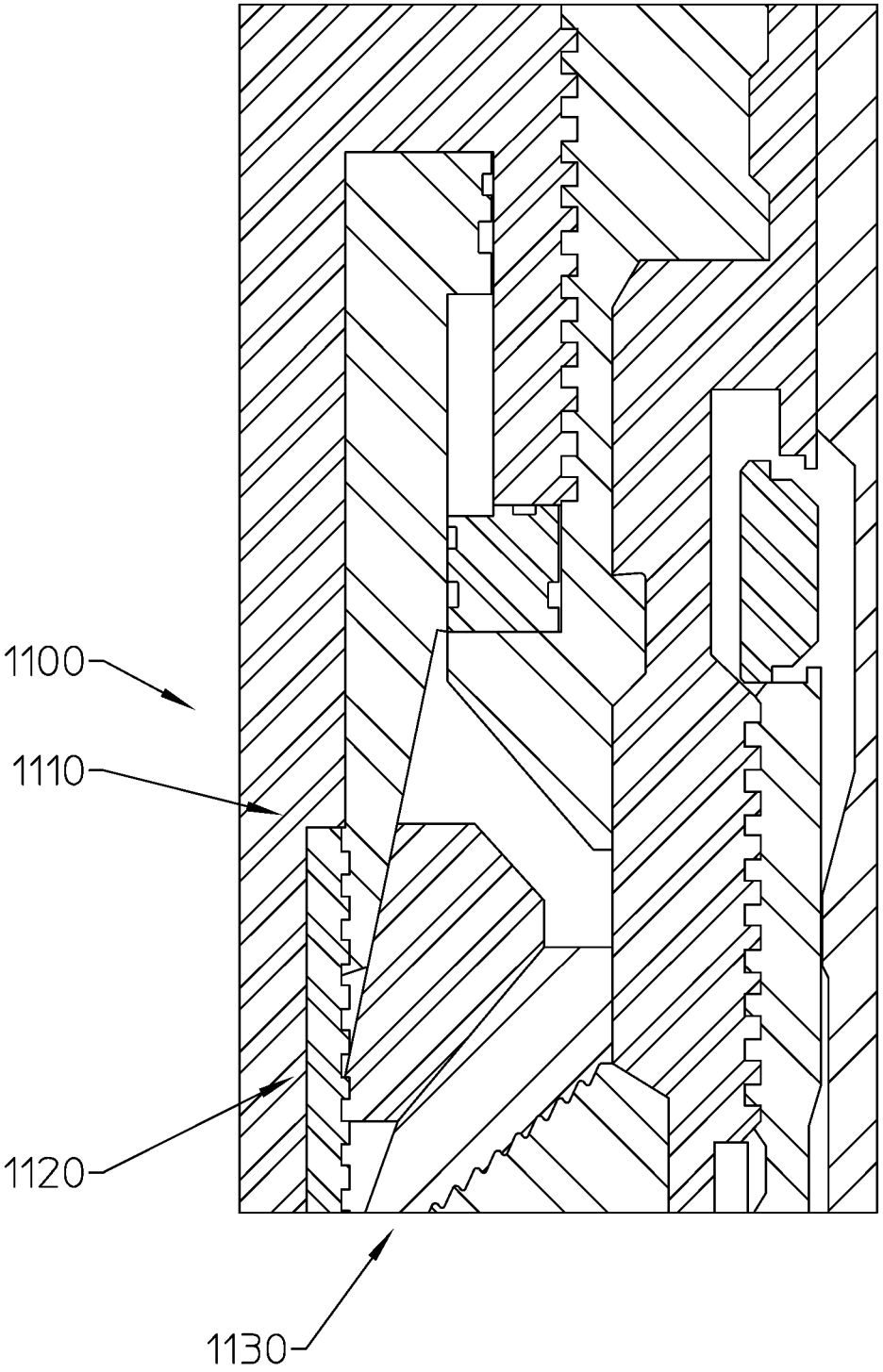
FIG. 11 is a partial cross-sectional view of a tubing hanger locking system, in accordance with an embodiment of the present disclosure.

Referring now to FIG. 11, a tubing hanger locking system 1100, according to one or more embodiments of the present disclosure, is illustrated. The tubing hanger locking system 1100 may include, at least, a piston 1110, locking dogs 1120, and a wedge 1130. The piston 1110, the locking dogs 1120, and the wedge 1130 may be configured and coupled such that the tubing hanger locking system 1100 locks a tubing hanger in place within a wellhead housing and rigidizes a tubing hanger and casing hanger within the wellhead housing.

While one or more embodiments of the present disclosure may include a piston 50, 550, 650, 750, 850, 950, 1050, one of ordinary skill would appreciate that in other embodiments, a space-out mechanism of a tubing hanger system may instead include a lower member, which may be a non-actuating member. However, as discussed above with respect to pistons of one or more embodiments of the present disclosure, the lower member may include, at least, ramp surfaces and rotational stop surfaces and may be configured to interact with a ramp ring in order to lock a casing hanger and a tubing hanger system in place within a wellhead housing and rigidize the system.

It should be understood that the present disclosure contemplates a method to lock and rigidize a tubing hanger system and casing hanger within a wellhead housing. The present disclosure also contemplates a method to assemble a tubing hanger system.

In one or more embodiments of the present disclosure, assembly of the tubing hanger system may include disposing a space-out mechanism about a first sealing profile and second sealing profile of a tubing hanger body. Further, in one or more embodiments where the space-out mechanism includes a ramp ring and a piston, a ramp ring may be disposed about the second sealing profile of the tubing hanger body. Then, in one or more embodiments including a safety mechanism for locking a rotation of the ramp ring relative to the tubing hanger body, the portions of the safety mechanism in the ramp ring and in the tubing hanger body may be aligned and coupled. This may further include disposing a safety lock spring in a pin blind hole, disposing a safety lock pin on top of the safety lock spring in the pin blind hole, and disposing a pin securing mechanism into the opening of the pin blind hole. Further, once the safety mechanism for locking a rotation of the ramp ring relative to the tubing hanger body is properly aligned and the safety lock pin is inserted into the pin counterbore of the tubing hanger body, a safety lock rod may be disposed within an elongated hole in the tubing hanger body. Further, if a space-out mechanism requires a pre-load to be applied to a mechanism configured to rotate the ramp ring relative to the tubing hanger body, the pre-load will be applied before rotationally locking the ramp ring and the tubing hanger body by way of the safety mechanism.

Then, in one or more embodiments, a piston may be disposed about the first sealing profile and the second sealing profile of the tubing hanger body. Once the piston is properly installed such that the seals of the tubing hanger body are properly located within the piston, the piston and the tubing hanger body may be aligned such that the anti-rotation pin may be threaded into the threaded pin borehole of the piston and extend into a pin slot of the tubing hanger body. Additionally, in one or more embodiments, a retainer ring may be disposed within a third groove of the tubing hanger body.

Additionally, in one or more embodiments of the present disclosure, locking and rigidizing a tubing hanger system and casing hanger within a wellhead housing may include running an assembled tubing hanger system into the wellhead housing, landing the tubing hanger system on the casing hanger and sealing a tubing hanger to casing hanger seal of the tubing hanger body against the casing hanger. Landing the tubing hanger system on the casing hanger may further include collapsing a retaining ring into a third groove of the tubing hanger body. Then, in one or more embodiments, a seal test on the tubing hanger to casing hanger seal may be performed. Once the seal test confirms that the seals are properly set, the tubing hanger may be locked. The process of locking the tubing hanger may activate the safety lock rod and engage the locking dogs into their locking profile within the wellhead housing. Then, the tubing hanger body may be lifted to preload the locking mechanism in place within the wellhead housing.

In one or more embodiments, the space-out mechanism may then be actuated, taking up any axial gaps created by lifting on the tubing hanger body and rigidizing the tubing hanger system within the wellhead housing. Actuating the space-out mechanism may further include unlocking a safety mechanism. Unlocking the safety mechanism may include compressing a safety locking rod into an elongated hole of the tubing hanger body and pushing a safety lock pin out of a pin counterbore of the tubing hanger body such that the ramp ring is no longer rotationally locked to the tubing hanger body. Actuating the space-out mechanism may further include moving the piston down to push against the casing hanger, rotating the ramp ring, and filling the gap between the piston and the tubing hanger body. Once the space-out mechanism has been activated to rigidize the tubing hanger body and the casing body within the wellhead housing, the casing hanger seal may be seal tested to ensure that it is still properly sealing. Then, finally, the tubing hanger system may be released.

Space-out mechanisms, as described at length above, may be used in other contexts as well to rigidize wellhead system components by removing any axial gaps in the wellhead system created during the process of landing/locking components of the wellhead system. For example, a space-out mechanism may be used to close out any axial gaps in a connection between a casing hanger and the wellhead housing (e.g., prior to landing a tubing hanger).

In some cases, machining tolerances may give rise to small gaps between a locking mechanism (e.g., lock ring) of a seal assembly and an upper edge of a complementary lock profile of the wellhead when the seal assembly is landed and locked to seal an annulus between the casing hanger and the wellhead. Such gaps may enable the seal assembly located between the casing hanger and the wellhead to move up and down axially in response to pressure differentials. Over time, this motion of the seal may cause undesirable wear on the seal, increasing the chance for failure.

Figure 12:
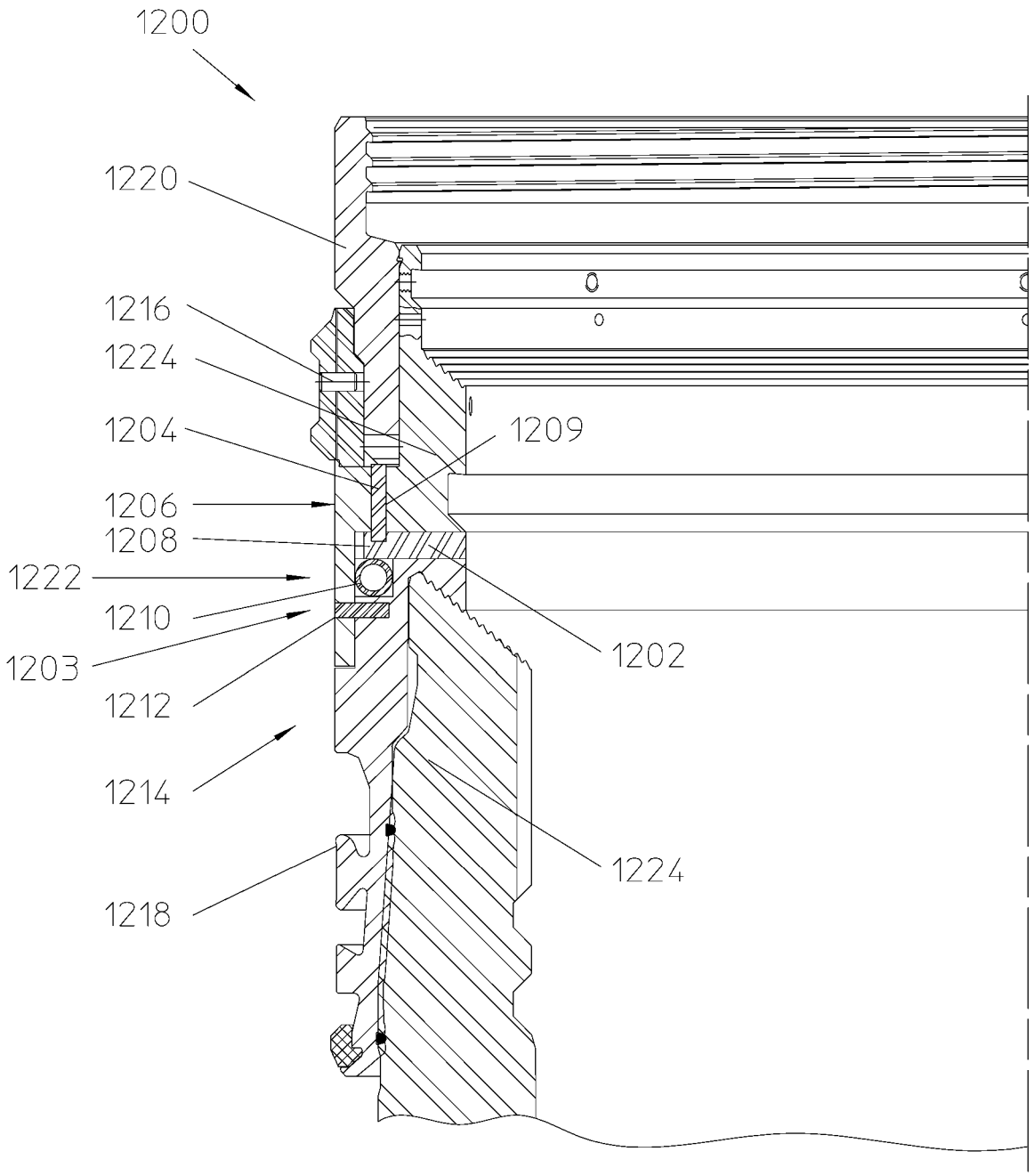
FIG. 12 is a partial cross-sectional view of a seal assembly having enhanced rigidity, in accordance with an embodiment of the present disclosure.
Figure 13A:
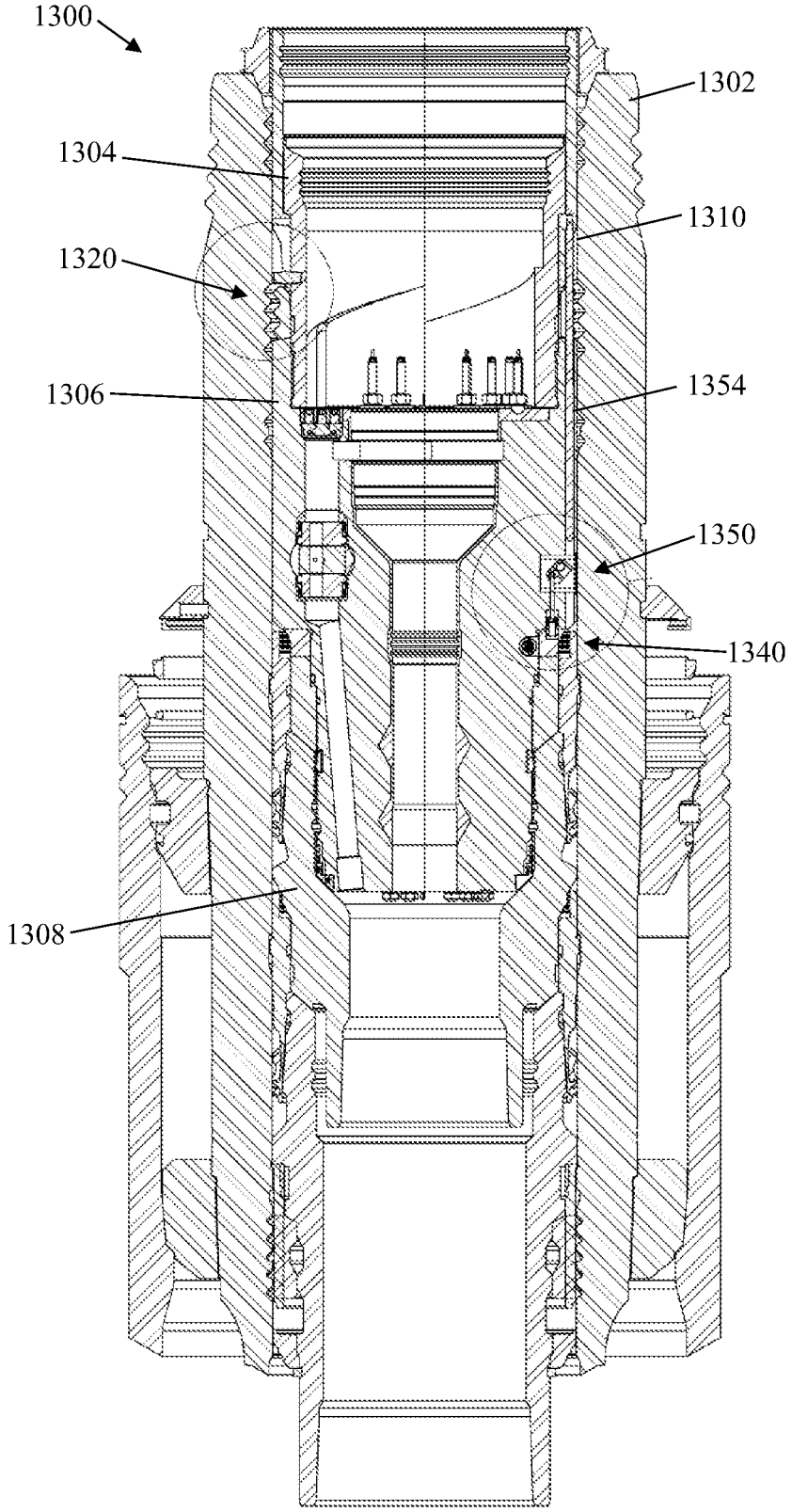
FIGS. 13A-13C are cross-sectional views of a system including a tubing hanger with space-out mechanism being run into a wellhead housing and a tapered lock ring actuator, in accordance with an embodiment of the present disclosure.
Figure 13B:
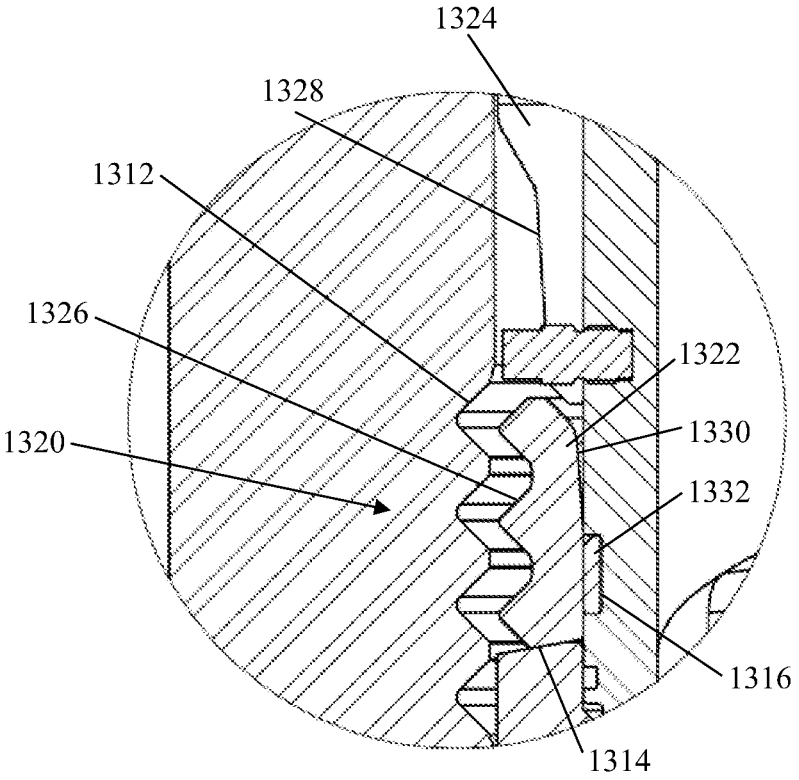
Figure 13C:
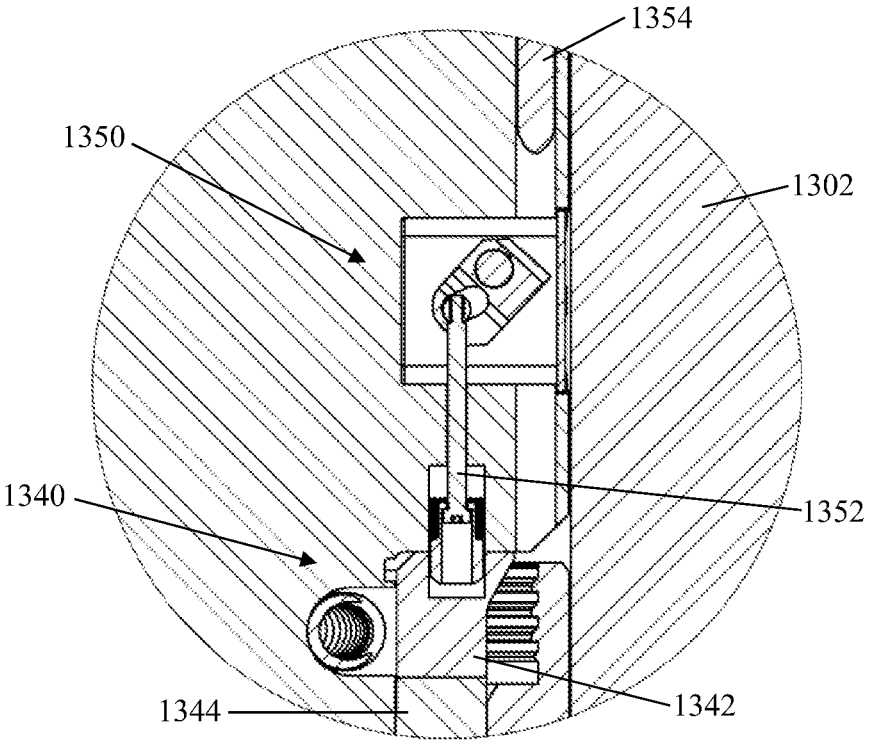
Figure 14A:
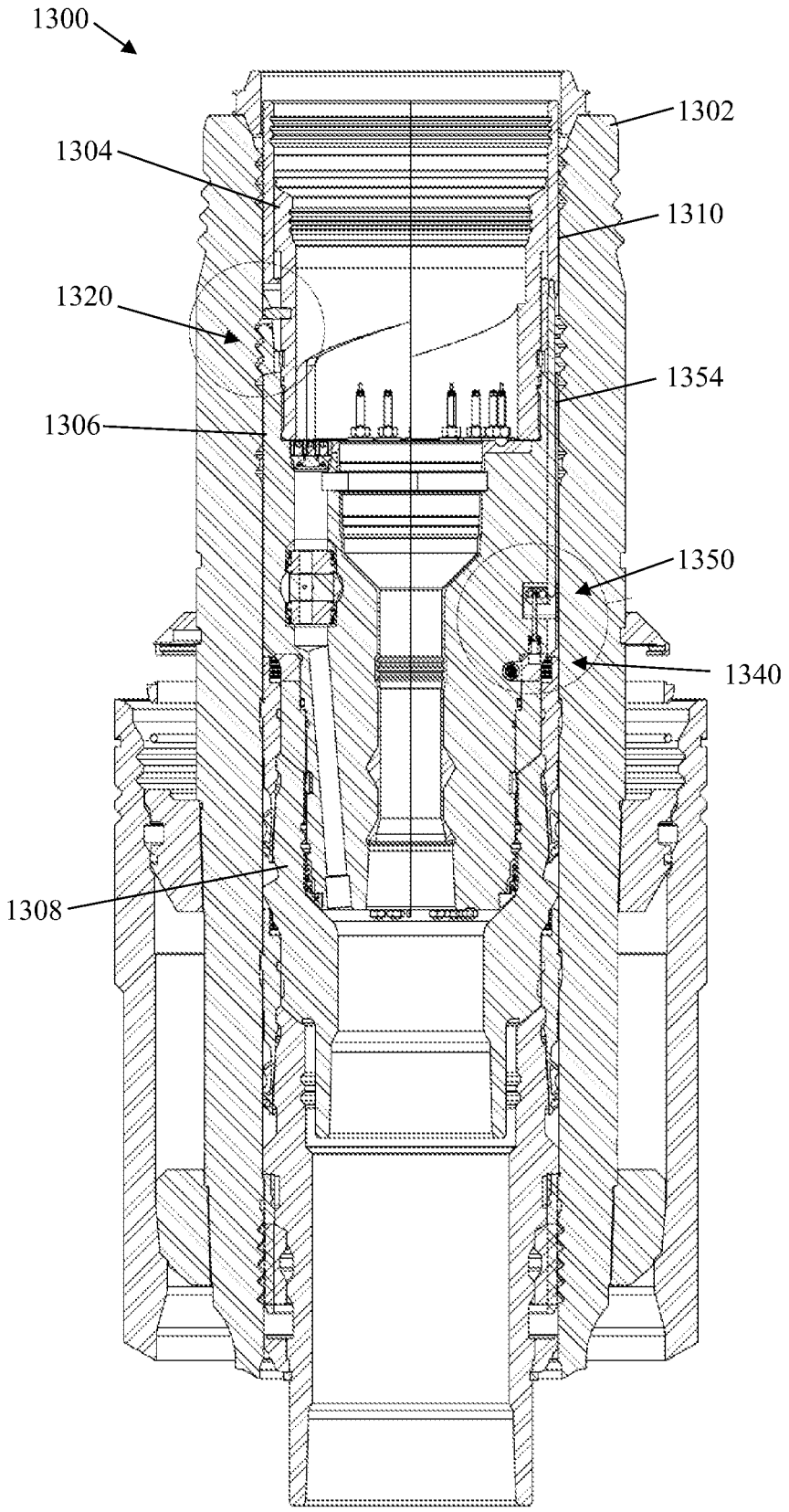
FIGS. 14A-14C are cross-sectional views of the system of FIGS. 13A-13C as the lock ring is moved out to engage grooves in the wellhead housing, in accordance with an embodiment of the present disclosure.
Figure 14B:
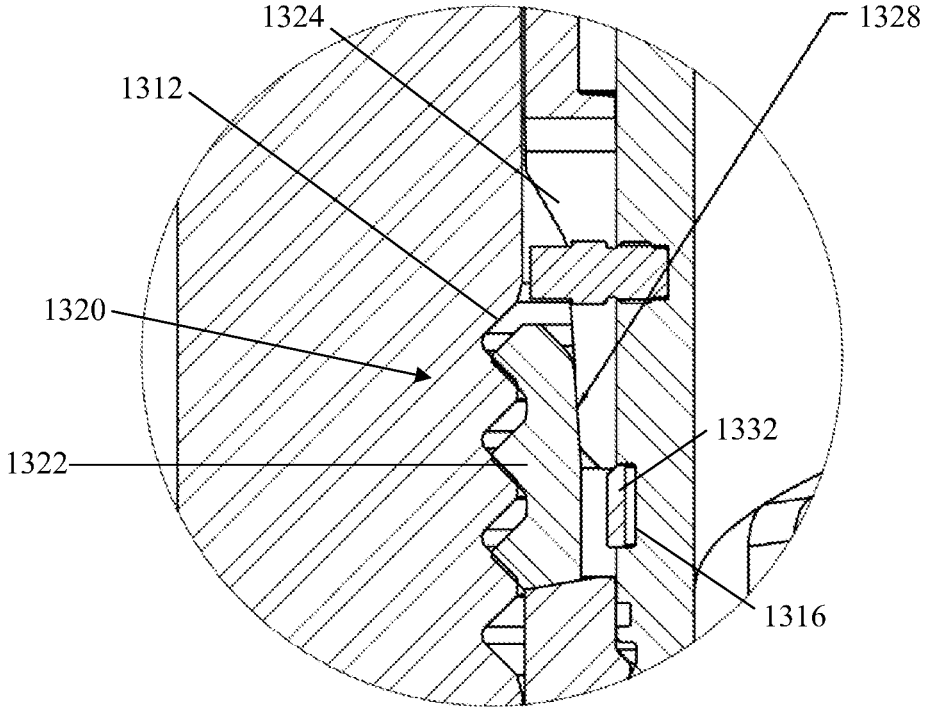
Figure 14C:
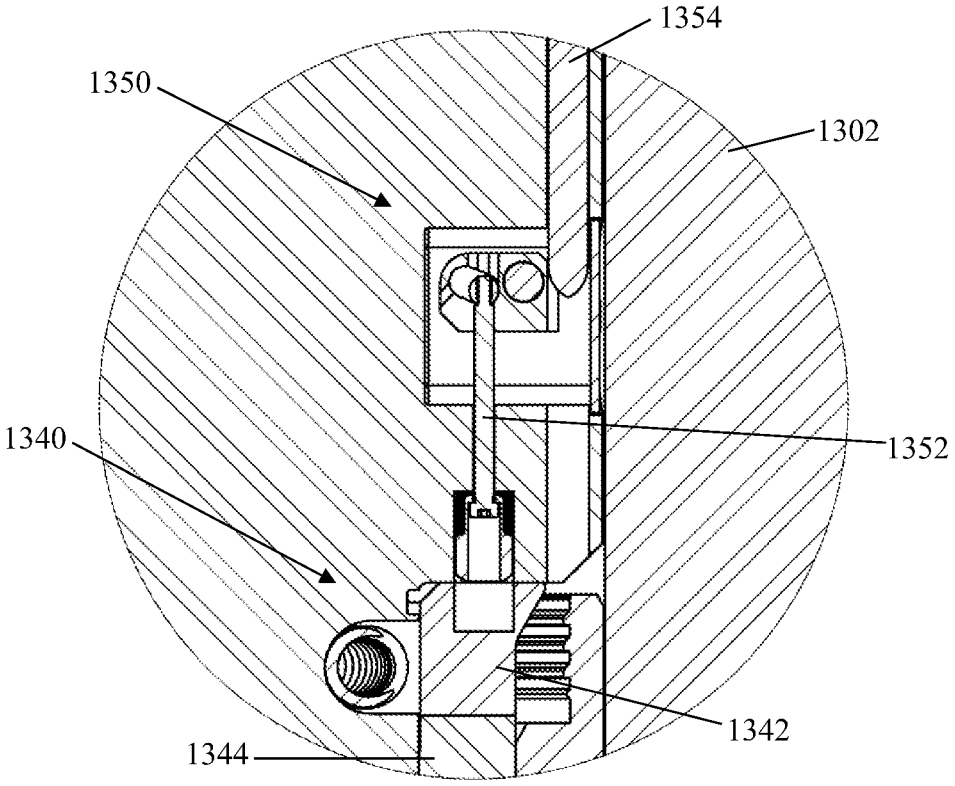
Figure 15A:
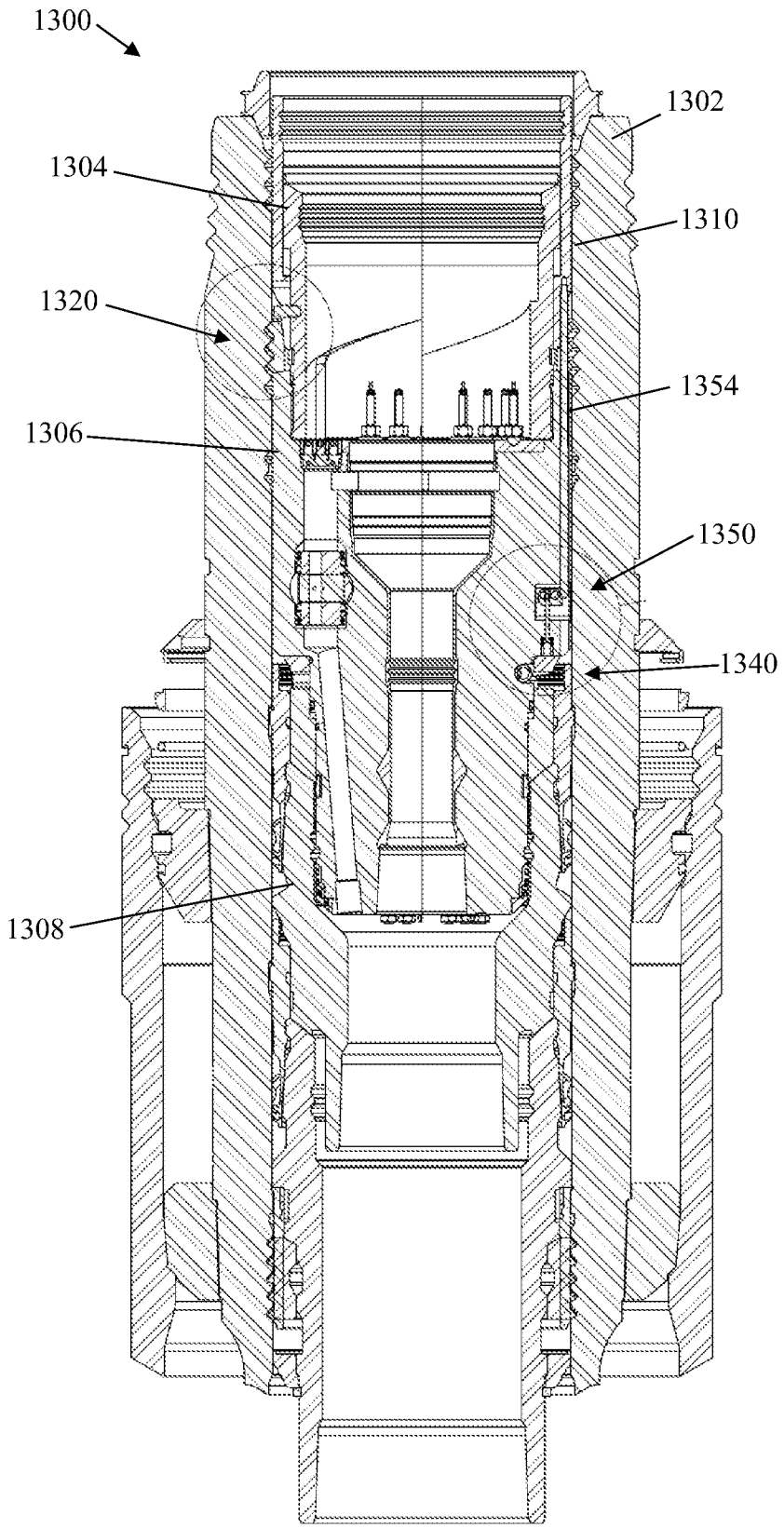
FIGS. 15A-15C are cross-sectional views of the system of FIGS. 13A-13C as the space-out mechanism actuates, in accordance with an embodiment of the present disclosure.
Figure 15B:
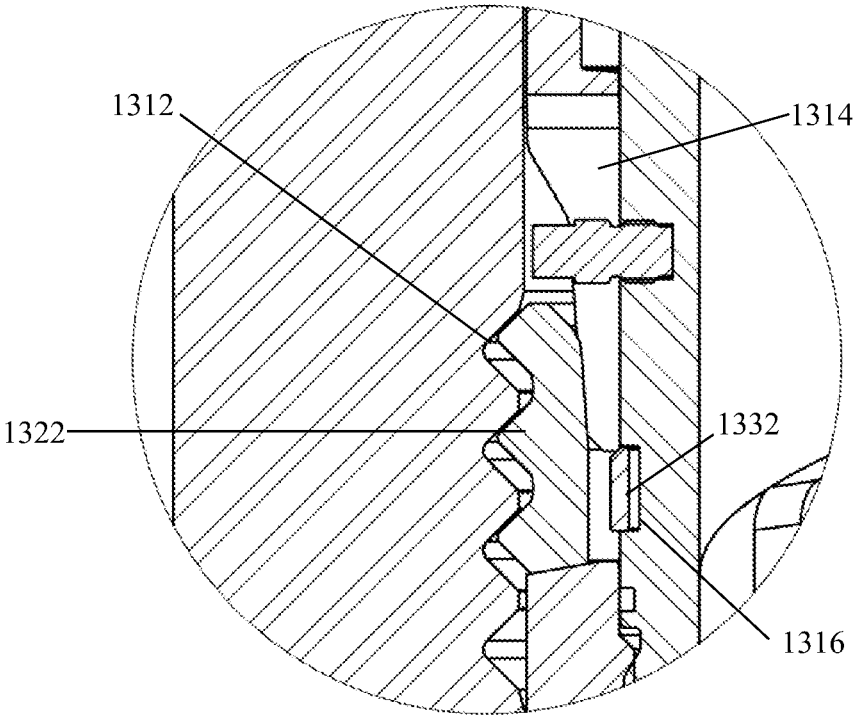
Figure 15C:
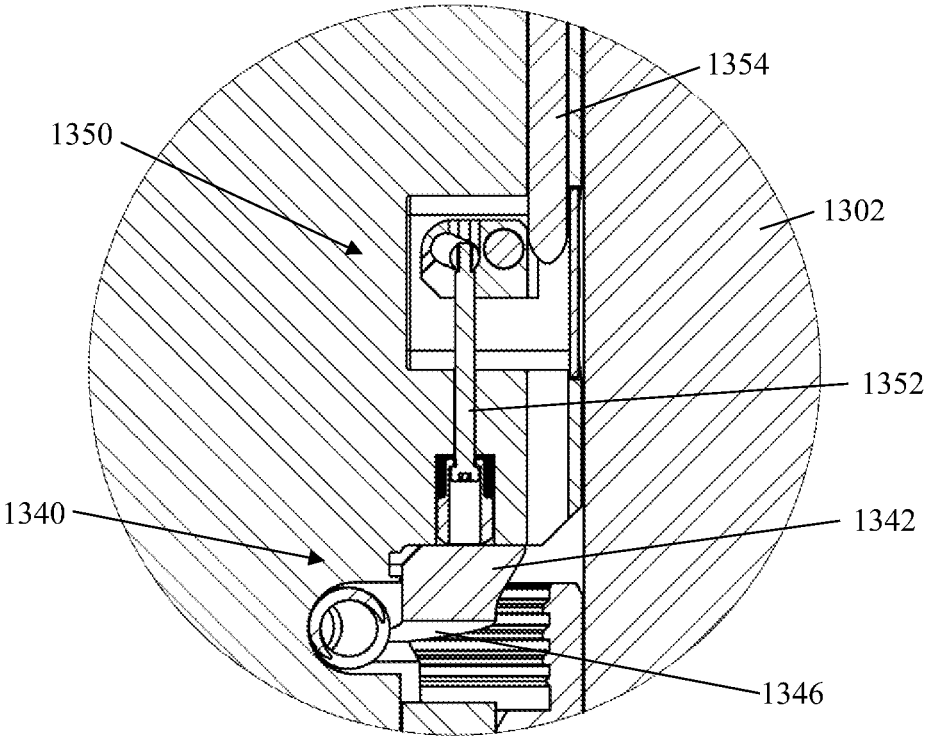
Figure 16A:
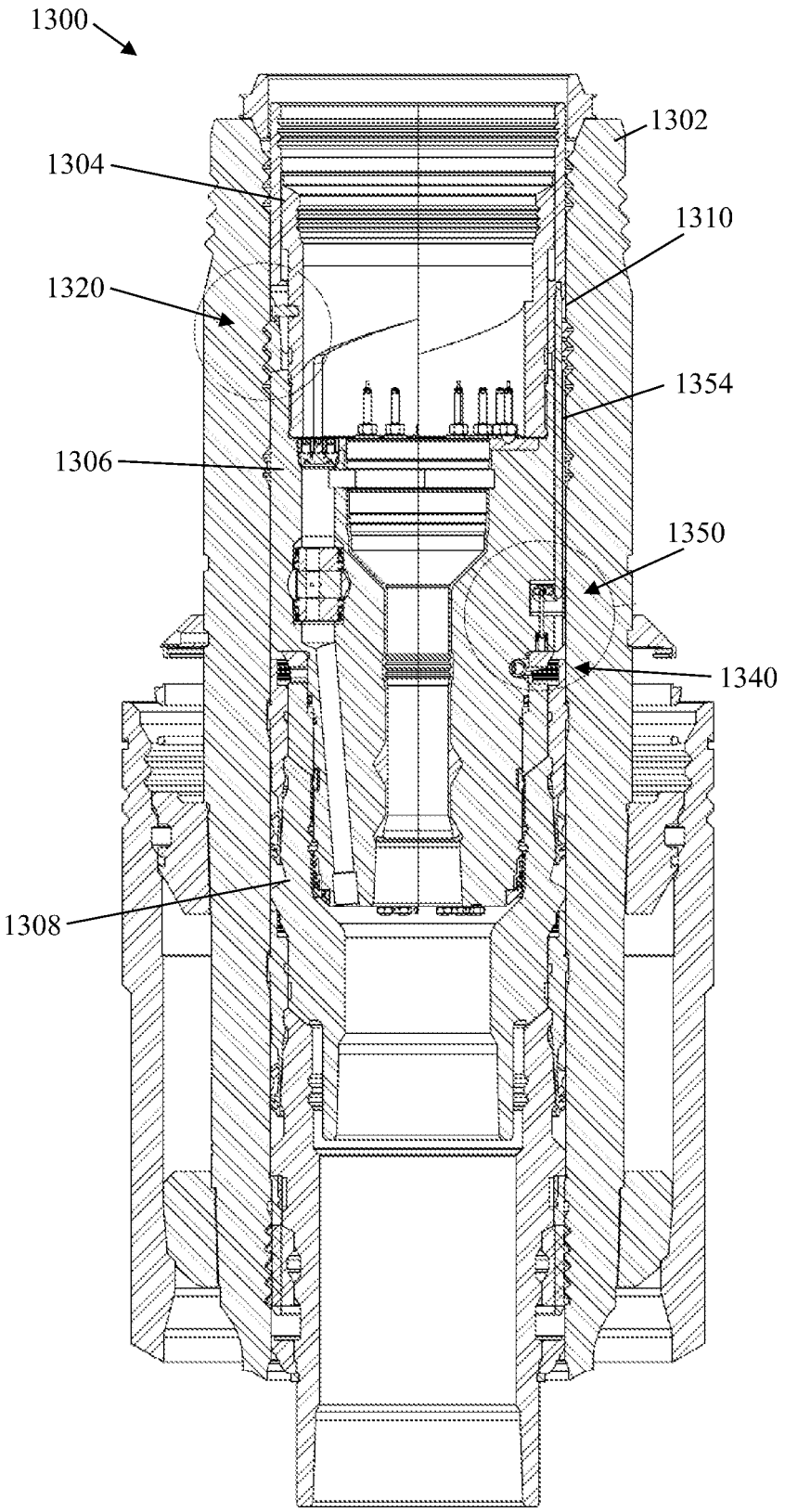
FIGS. 16A-16C are cross-sectional views of the system of FIGS. 13A-13C as the tapered lock ring actuator moves downward to add pre-load to the tubing hanger, in accordance with an embodiment of the present disclosure.
Figure 16B:
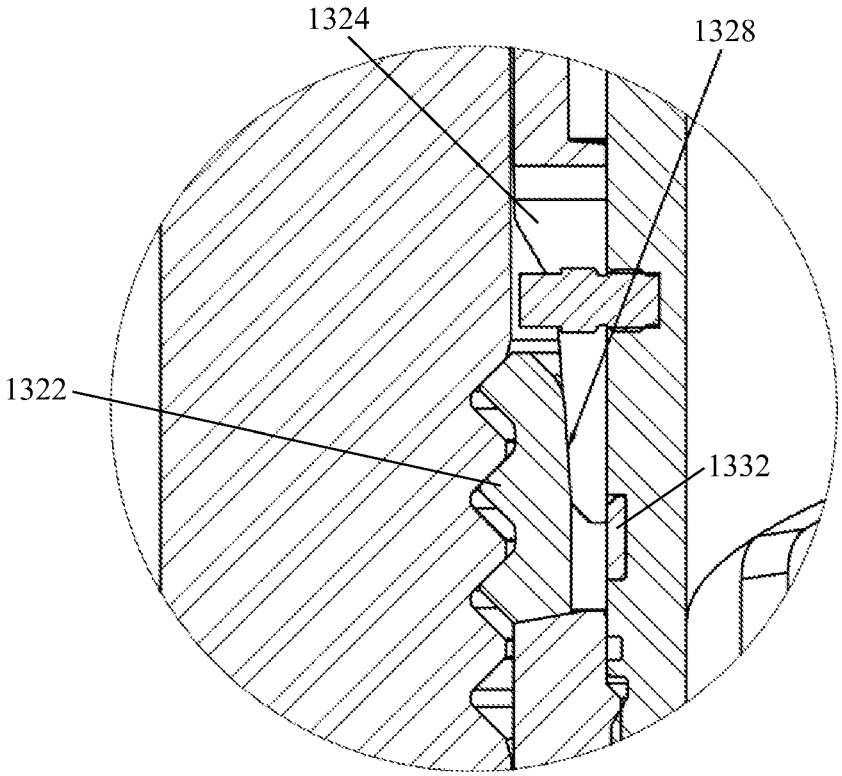
Figure 16C:
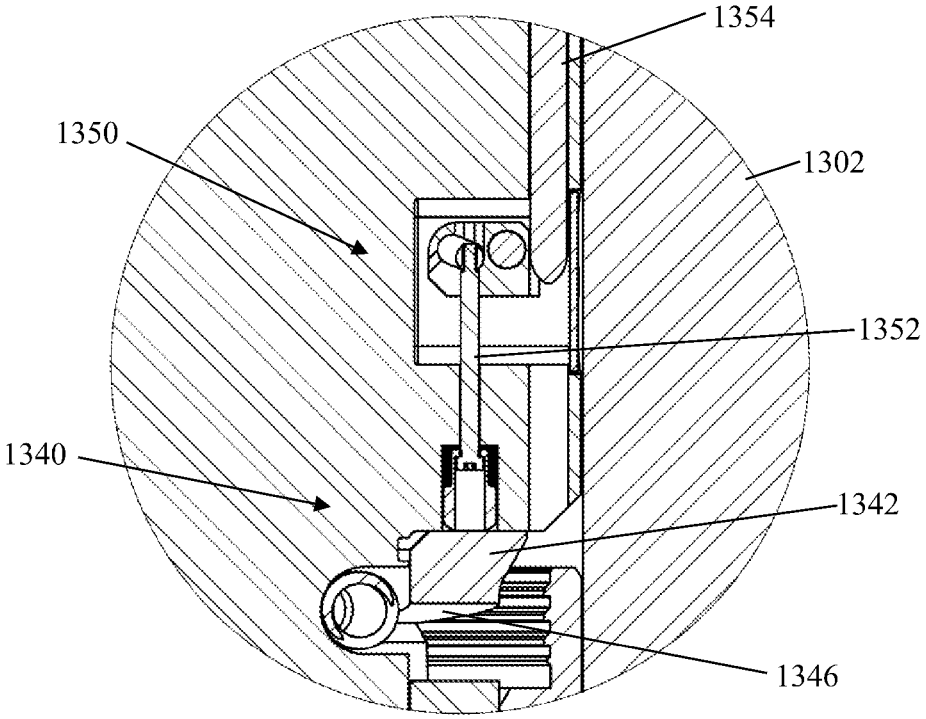
Figure 17A:
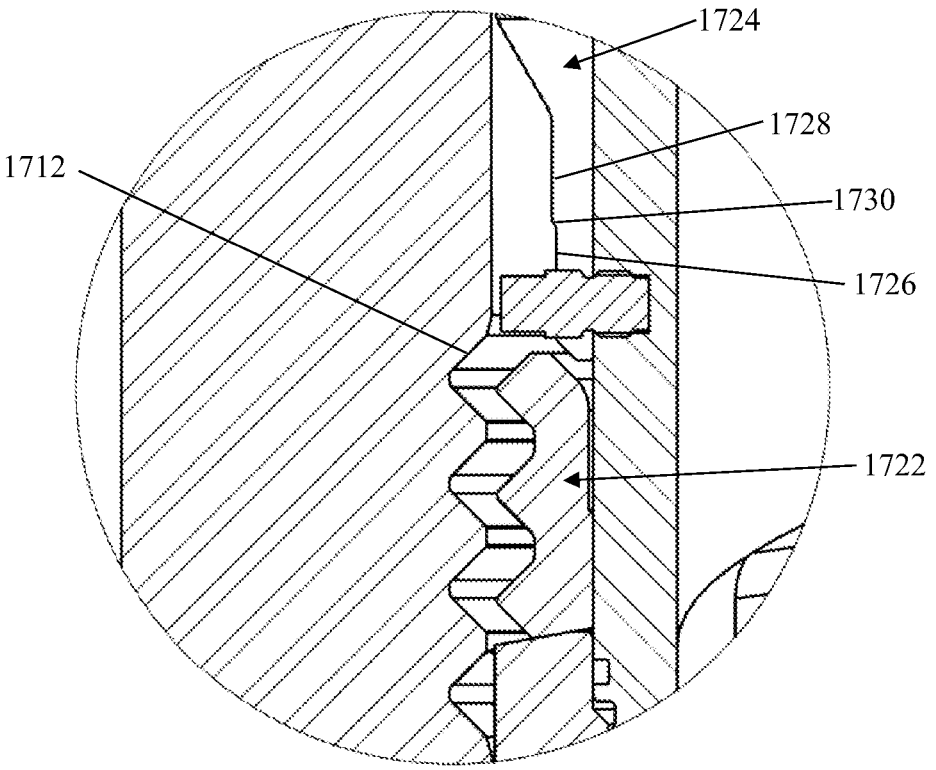
FIGS. 17A-17D are cross-sectional views of a dual flat lock ring actuator being used during a tubing hanger installation process, in accordance with an embodiment of the present disclosure.
Figure 17B:
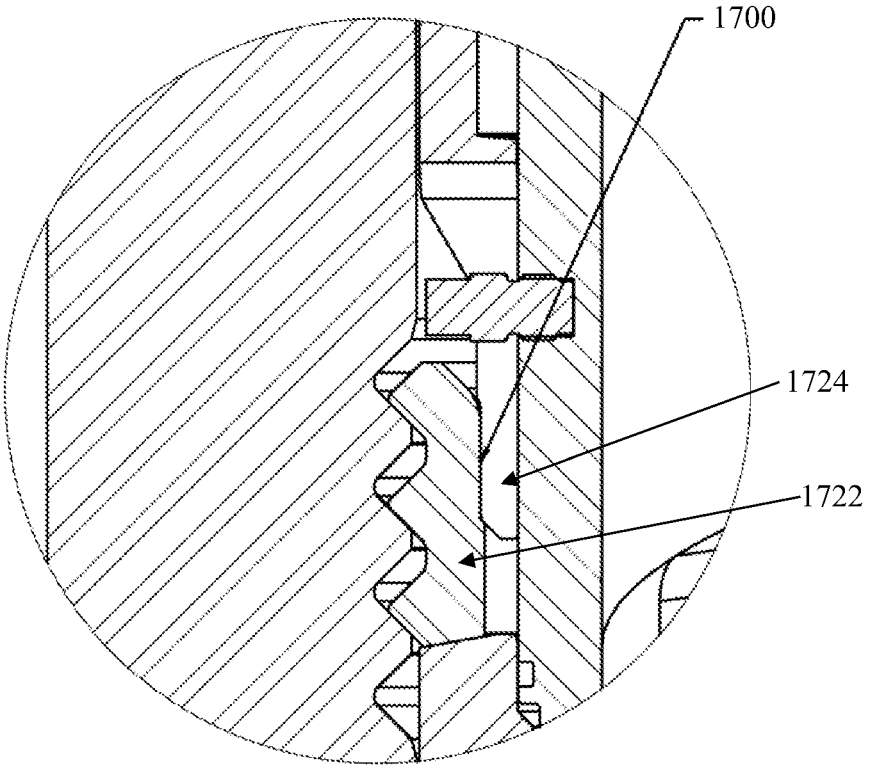
Figure 17C:
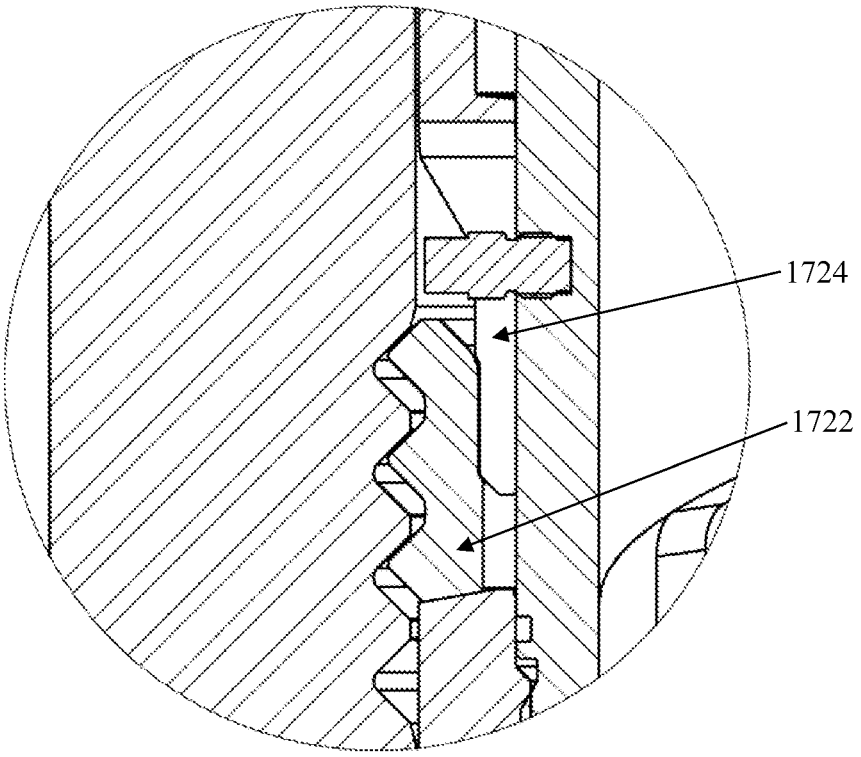
Figure 17D:
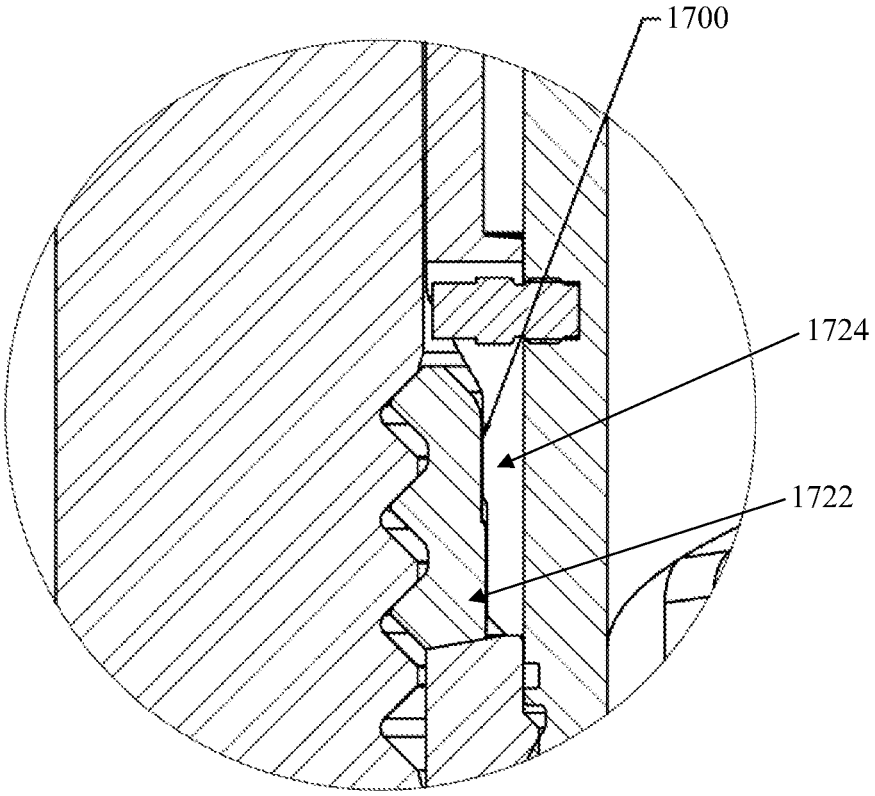
Figure 18A:
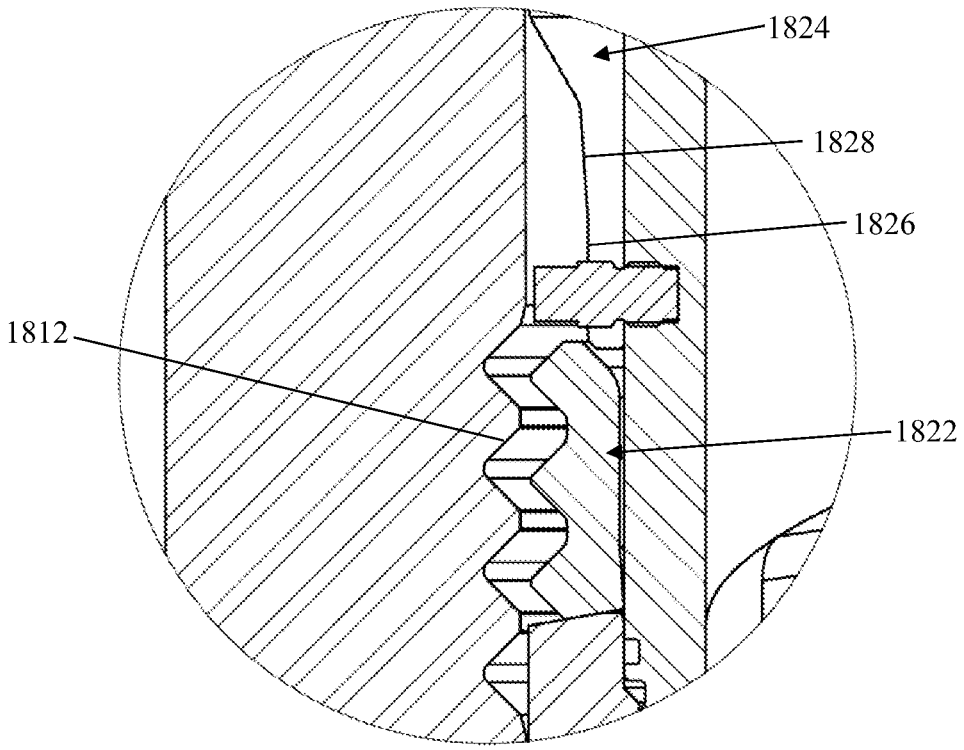
FIGS. 18A-18D are cross-sectional views of a flat to tapered lock ring actuator being used during a tubing hanger installation process, in accordance with an embodiment of the present disclosure.
Figure 18B:
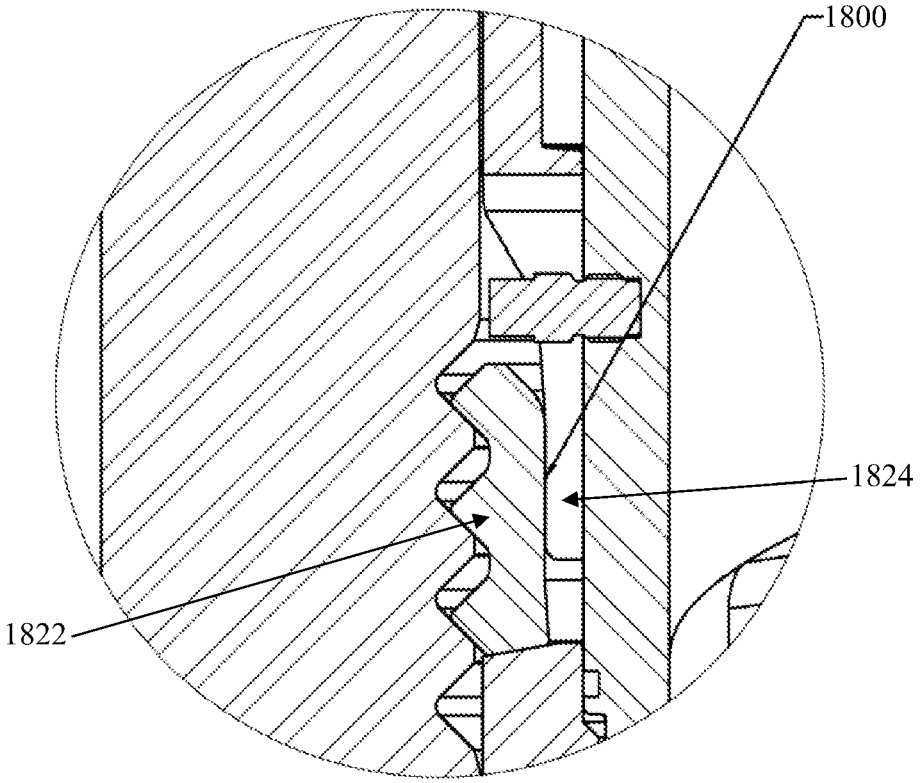
Figure 18C:
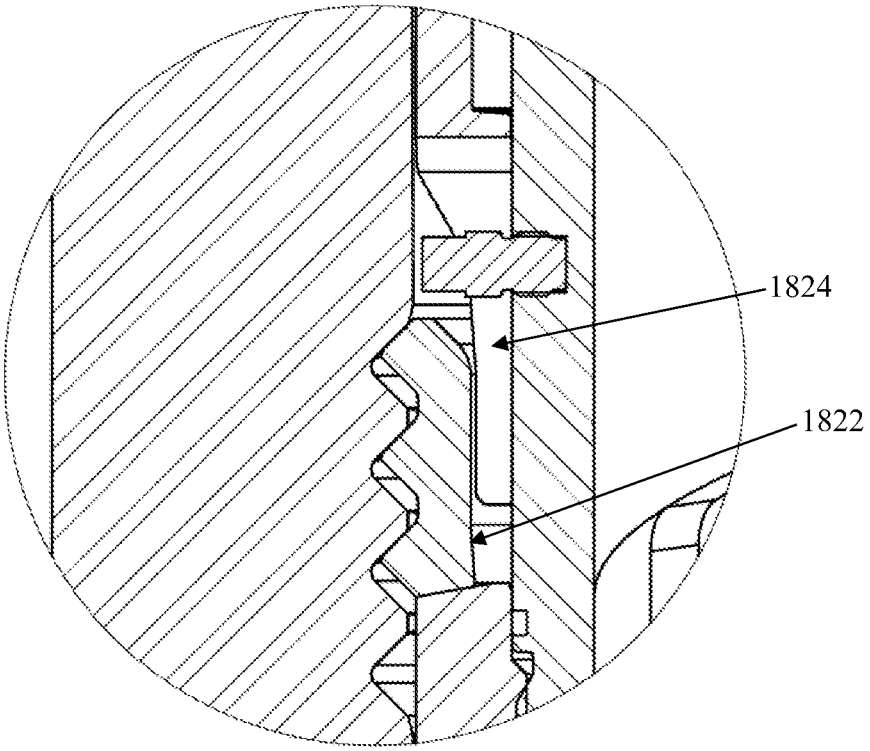
Figure 18D:
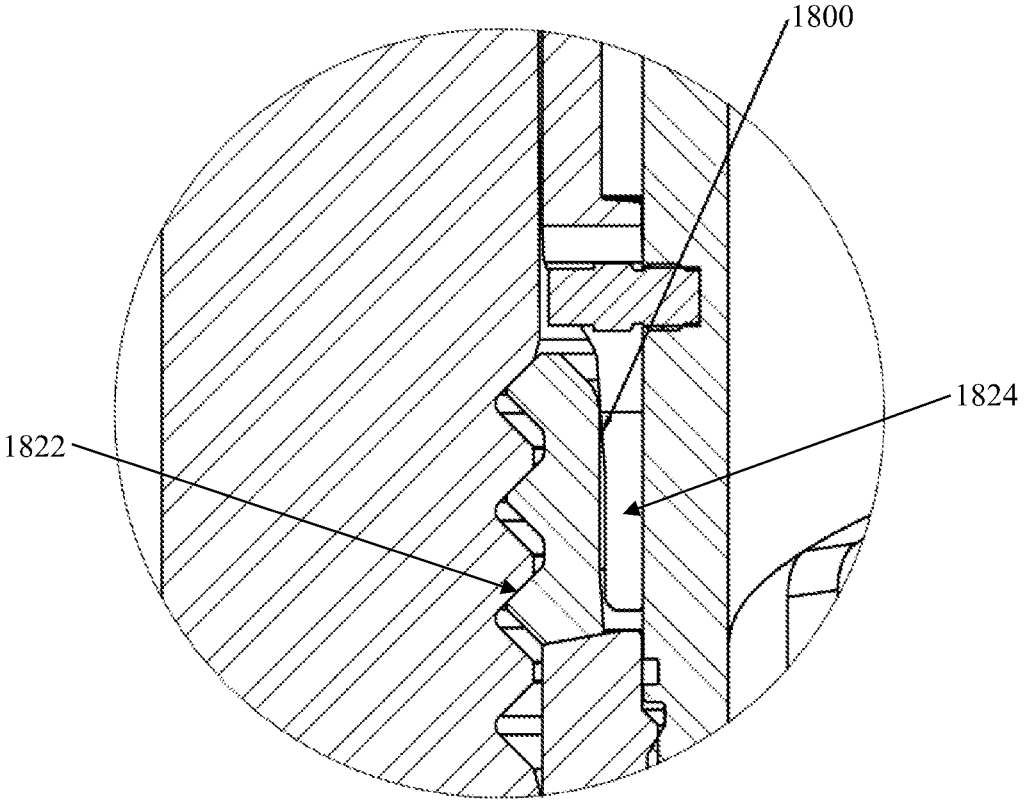
Figure 19A:
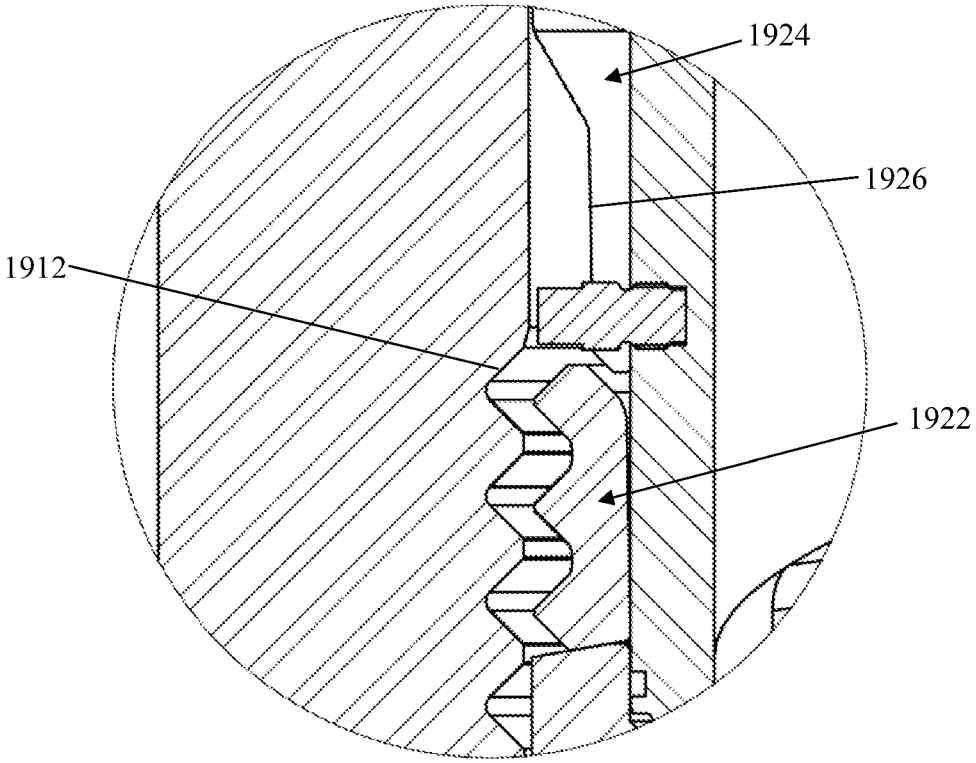
FIGS. 19A-19D are cross-sectional views of a low angle tapered lock ring actuator being used during a tubing hanger installation process, in accordance with an embodiment of the present disclosure.
Figure 19B:
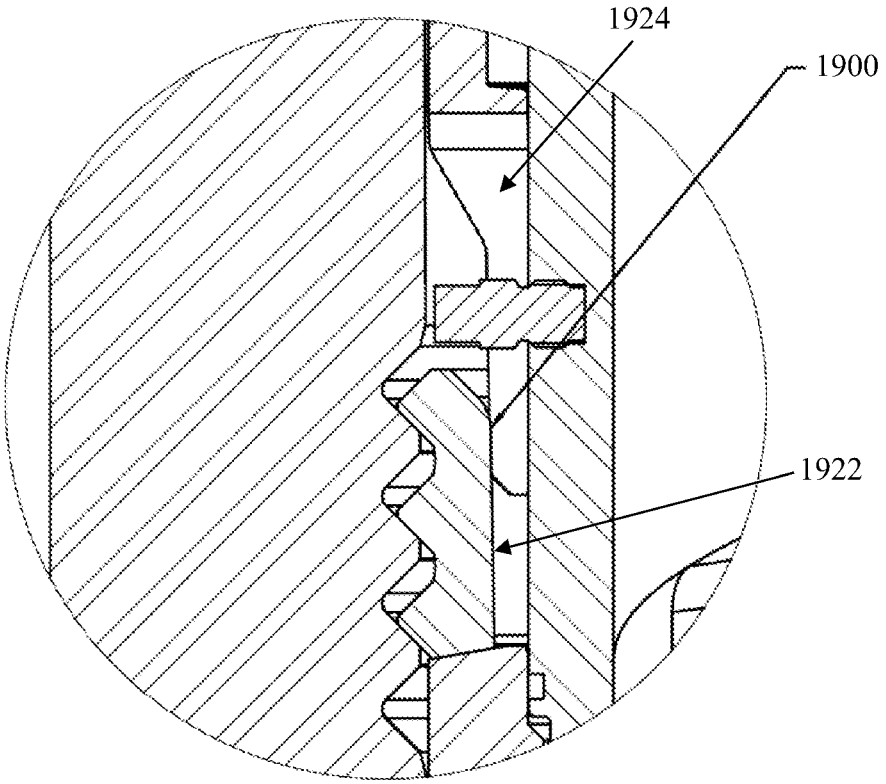
Figure 19C:
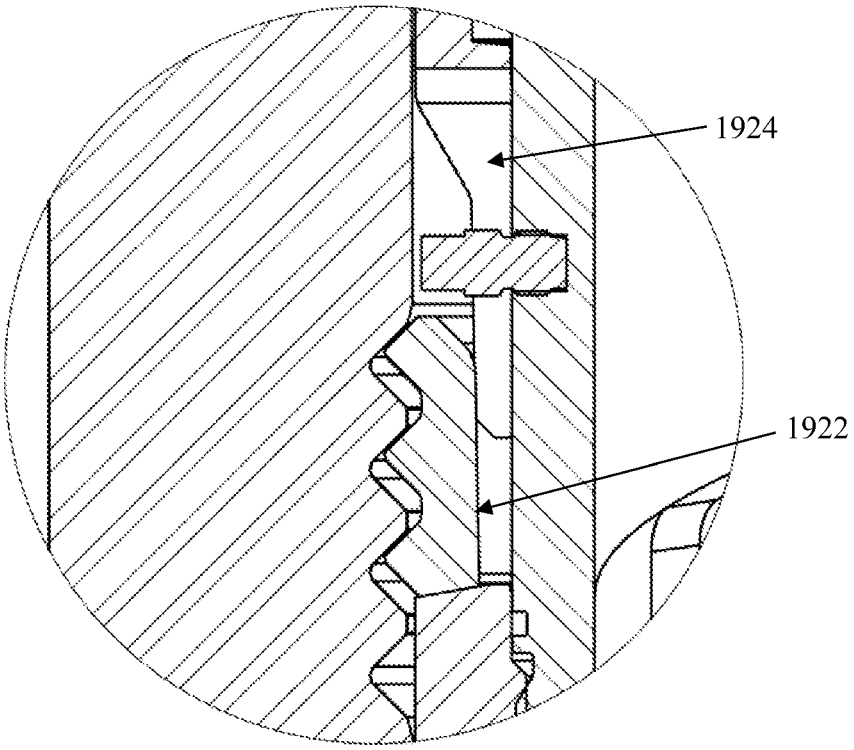
Figure 19D:
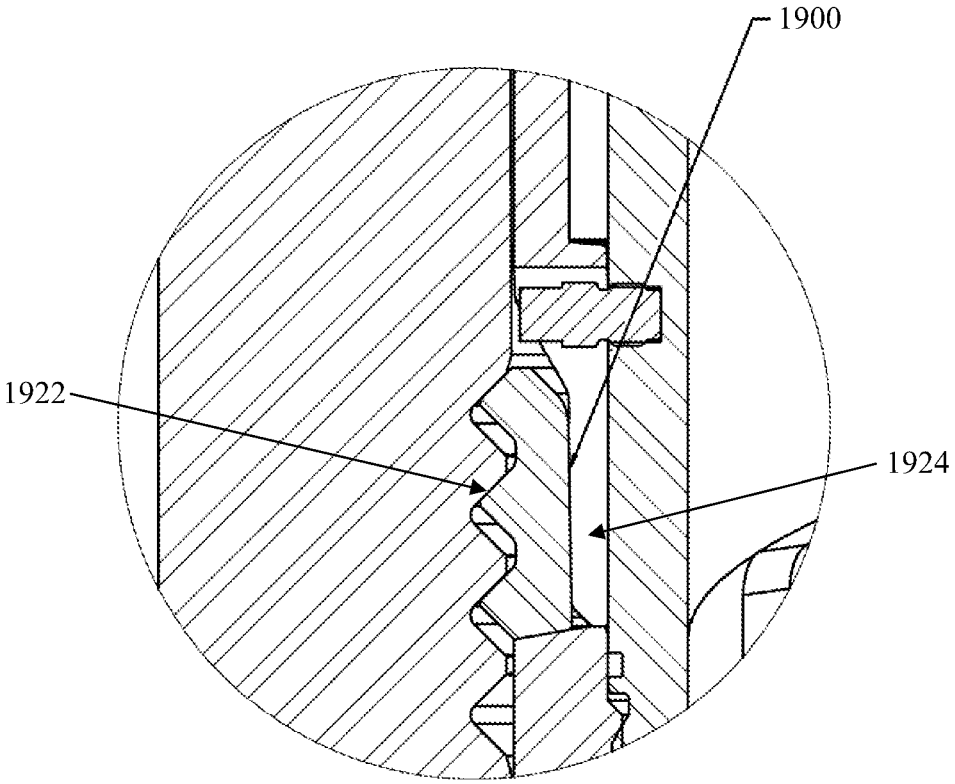

To address this issue, a seal assembly 1200, as depicted in FIG. 12, may be equipped with a space-out mechanism 1222 used to reduce gaps and rigidize the system. The seal assembly 1200 may include an upper body 1206, a lower body 1214, an actuator sleeve 1220, and a locking mechanism 1216. The seal assembly 1200 may first be lowered into a wellhead. Once lowered, the seal assembly 1220 may land upon the casing hanger 1224. Weight may be applied to the seal assembly 1220 via a running tool (not shown); this weight may cause the actuator sleeve 1220 to move downward with respect to the upper body 1206 and the locking mechanism 1216, thereby pushing the locking mechanism 1216 into grooves of the inner diameter profile of the wellhead housing (not shown). Once the actuator sleeve 1220 has moved down, there may remain a gap between the locking mechanism 1216 and the uppermost edge of the grooves. To increase the rigidity of the system, it is desirable to reduce, minimize, or eliminate such a gap.

The seal assembly 1200 of FIG. 12 includes a space-out mechanism 1222, which may be coupled between the upper body 1206 and the lower body 1214 as shown. The upper body 1206 may be coupled to the locking mechanism 1216. The lower body 1214 may land on a landing shoulder of the casing hanger 1224. The lower body may include a seal 1218, which may be rigidized in accordance with teachings of the present disclosure. The space-out mechanism 1222 may be utilized to increase the axial distance between the upper body 1206 and the lower body 1214 in order to ensure that (1) the seal 1218 has landed at the appropriate location; and (2) the locking mechanism 1216 is positioned against the upper edge of the corresponding profile of the inner diameter of the wellhead (not shown).

The space-out mechanism 1222 may include a ramp ring 1202 and an actuation mechanism 1203. The actuation mechanism 1203, in the illustrated embodiment, includes a spring and 1210 and a pressure-actuated release mechanism 1212. The pressure-actuated release mechanism 1212 may be any mechanism suitable to prevent the lower body from descending until a threshold pressure is reached; for example, the pressure-actuated release mechanism 1212 may be a shear pin or other shearable actuation component.

In certain embodiments, the ramp ring 1202 may be configured to rotate relative to the upper body 1206 and the lower body 1214. The ramp ring 1202 may comprise at least one tapered surface, and the upper body 1206 may comprise at least one tapered surface configured to interface with the at least one tapered surface of the ramp ring 1202. The tapered surfaces of the ramp ring 1202 and the upper body 1206 may be complementary. Furthermore, the tapered surfaces of the ramp ring 1202 and the upper body 1206 may be configured to bear against each other to rigidize the system. In certain embodiments, the at least one taper of each of the ramp ring 1202 and the upper body 1206 may have a slope between 0.5° and 7°. The ramp ring 1202 of the space-out mechanism 1222, according to one or more embodiments of the present disclosure, may include a lower contact surface configured to interface with an upper contact surface of the lower body 1214. Additionally, in one or more embodiments, an upper surface of the ramp ring 1202 may have a plurality of ramp surfaces and a plurality of rotational stop surfaces. For example, the ramp ring 1202 may take the form of the ramp ring (e.g., ramp ring 40) shown in FIG. 3A, except that the ramp surfaces and stop surfaces are on the top of the ramp ring instead of the bottom. For example, in one or more embodiments, the ramp ring 1202 may include three ramp surfaces each extending 120° circumferentially about the ramp ring 1202. However, one of ordinary skill in the art will understand that in other embodiments, the ramp ring 1202 may have a single ramp surface and a single rotational stop surface or any combination of equal numbers of ramp surfaces and rotational stop surfaces that match the number of ramp surfaces and rotational stop surfaces of the upper body 1206. Further, in one or more embodiments of the present disclosure, the ramp surface(s) may have a constant 3.5° taper. However, one of ordinary skill in the art will understand that in other embodiments the ramp surface(s) may include steps or ridges and/or may have a constant or changing taper in the range of 0.5°-7°. Alternatively, the ramp surface(s) may include any range of angles, surface geometries, and/or coatings that prevent rotation once installed.

The ramp ring 1202 of the space-out mechanism 1222 may be configured to rotate via the spring 1210 relative to the upper body 1206 and the lower body 1214. In one or more embodiments, the ramp ring 1202 may be rotationally coupled to the lower body 1214 by a circumferential spring mechanism (which may or may not be similar to the circumferential spring mechanism 580 of FIG. 5A) including the spring 1210. The circumferential spring mechanism may be coupled to the ramp ring 1202 on a first end and to the lower body 1214 on a second end. The spring 1210 may be disposed within a circumferential groove (not shown) located on the lower body 1214. Further, the spring 1210 may be directly coupled to the lower body 1214 by a spring connector (not shown) on a first end of the circumferential groove and may be coupled (e.g., via a transfer block, spring connector, and/or bolts) to the ramp ring 1202.

In one or more embodiments, when assembling the seal assembly 1200 before run-in, the circumferential spring mechanism may be preloaded such that when a safety mechanism locking the upper body 1206 to the lower body is disengaged, the space-out mechanism 1222 self-actuates to rotate the ramp ring 1202 against the lower body 1214 to extend the space-out mechanism 1222 axially and remove any axial gaps that have formed during installation of the seal assembly 1200 into wellhead housing. When the space-out mechanism 1222 is actuated, the rotation of the ramp ring 1202 will cause the ramp surface(s) of the ramp ring 1202 to bear against and rotate against the corresponding ramp surface(s) of the upper body 1206 and extend the space-out mechanism 1222 axially.

The pressure-actuated release mechanism 1212 may be a safety mechanism configured to lock the upper body 1206 to the lower body 1214 until a pressure is applied to disengage the pressure-actuated mechanism 1212. The pressure-actuated release mechanism 1212 may be any mechanism suitable to prevent the lower body 1214 from moving with respect to the upper body 1206 until a threshold pressure is reached; for example, the pressure-actuated release mechanism 1212 may be a shear pin. The shear pin may extend between the upper body 1206 and the lower body 1214. The actuation mechanism 1203 of the illustrated embodiment including the spring 1210 and shear pin are purely exemplary—any actuation mechanism for the space-out mechanism 1222 may be used without departing from the scope of the present disclosure. For example, and without limitation, one or more of a spring 1210, shear pin, other pressure-actuated release mechanism 1212, piston, ratchet, rod, spring plate, arm, slider, rack, and pinion may be used for actuation, such as those described at length above with reference to FIGS. 6A-10.

In certain embodiments, the space-out mechanism 1222 may include another safety mechanism according to one or more embodiments of the present disclosure. In particular, a spring-loaded rod 1204 disposed within the ramp ring 40 may be installed during assembly of the seal assembly 1200 and engage the upper body 1206 so as to rotationally lock the ramp ring 1202 to the upper body 1206 until the proper time in the seal assembly run-in sequence in which the ramp ring 1202 should be rotationally actuated in order to take up any axial space created by the installation procedure.

The safety mechanism may be similar to the safety mechanism illustrated in detail in FIG. 4 and described above. The only features of the safety mechanism illustrated in FIG. 12 are the spring-loaded rod 1204 (e.g., safety lock rod 72 of FIG. 4) and the corresponding pin securing mechanism 1208 (e.g., pin securing mechanism 45 of FIG. 4). It will be understood that the safety mechanism of FIG. 12 may also include a safety lock pin (e.g., 70 of FIG. 4) and a safety lock spring (e.g., 71 of FIG. 4) disposed within the ramp ring 1202. The spring-loaded rod 1204 may be disposed within the upper body 1206. The ramp ring 1202, in one or more embodiments, may include a pin blind hole disposed in an upper contact surface thereof with the pin securing mechanism 1208 disposed in the opening of the pin blind hole. Additionally, the upper body 1206, in one or more embodiments, may include an elongated hole 1209 that extends from an upward facing contact surface thereof to a downward facing contact surface thereof. Further, a pin counterbore (not shown) may be sunk into the downward facing contact surface and concentric with the hole 1209. The spring-loaded rod 1204 may be disposed within the hole 1209.

The safety mechanism may function similar to the assembly illustrated in FIG. 4 and described above with reference to FIG. 4. For example, in one or more embodiments of the present disclosure, when the seal assembly 1200 is assembled before run-in, the safety lock pin (not shown) may engage the pin counterbore (not shown). During the installation of the seal assembly 1200 within the wellhead housing, actuation of the locking mechanism 1216 may cause the actuator sleeve 1220 to compress the spring-loaded rod 1204 into the hole 1209, which will cause the bottom end of the spring-loaded rod 1204 to push the safety lock pin out of the pin counterbore. Once the safety lock pin is removed from the pin counterbore, the upper body 1206 and the ramp ring 1202 will no longer be rotationally locked with respect to each other, thereby allowing the ramp ring 1202 to rotate relative to the upper body 1206 (along the respective ramp surfaces) in order to remove any axial gaps in the seal assembly 1200 created during the process of locking and sealing the casing hanger 1224 within the wellhead housing.

The illustrated assembly of FIG. 12 may be utilized in a subsea wellhead system. In certain embodiments, the assembly of FIG. 12 may be utilized by performing a sequence of steps—one exemplary sequence is provided below.

First, the seal assembly 1200 may be landed on the casing hanger 1224 in the wellhead housing (not shown). The actuator sleeve 1220 may then be engaged, thereby extending the locking mechanism in a radially outward direction to lock the seal assembly 1200 to the wellhead and releasing the spring-loaded rod 1204 so that the ramp ring 1202 and the upper body 1206 are rotationally uncoupled. The seal assembly 1200 may then be pulled up via a seal assembly running tool (not shown).

Once the seal assembly 1200 is raised up such that the locking mechanism 1216 is engaged against the top of the inner profile on the wellhead, there may be a gap present between the lower body 1214 and the landing shoulder at the top of the casing hanger 1224. Accordingly, pressurized fluid may be pumped down an annulus between the outer diameter of the stem of the running tool and the inner diameter of the upper body 1206 and lower body 1214. The pressurized fluid may apply pressure to the inner diameter of the seal 1218 at the bottom of the lower body 1214, thereby causing the lower body 1214 to begin to descend. The lower body's movement may actuate the pressure-actuated release mechanism 1212 (e.g., shearing a shear pin), allowing the lower body 1214 to further descend with respect to the upper body 1206. Once the lower body 1214 has descended, the ramp ring 1202 and spring 1210 may automatically facilitate the closing of the gap.

Finally, the casing hanger/seal assembly running tool may be retrieved. The above list of steps should be understood as non-limiting—additional steps may be added or removed without departing from the scope of the present disclosure. Moreover, steps may be executed in a different order without departing from the scope of the present disclosure.

Locking mechanisms, as already explained in detail above, may be used to lock the tubing hanger assembly to the inner wall of the wellhead housing. Alternatively, in certain embodiments, locking mechanisms may also be used to lock the casing hanger assembly to the inner wall of the wellhead housing. When using a traditional type of locking system with a tubing hanger or casing hanger that has an automatic space-out mechanism, significant pre-load may not be able to be developed on the hanger assembly, e.g., from pressure from below. For example, significant pre-load may be about 100,000 lbs, about 1,000,000 lbs, or any other suitable value.

Referring now to FIGS. 13A-16C, a locking mechanism 1320 may be employed to address this issue, i.e., to lock a hanger assembly 1300 against a wellhead housing 1302 as well as preload the hanger assembly 1300 with a desired level of pre-load, for example, so as to enhance rigidization of the wellhead system. The hanger assembly 1300 may include an upper body 1304, a main body 1306, and a lower body 1308. The lower body 1308 may first be landed within the wellhead housing 1302. The main body 1306 may then be landed upon the lower body 1308 within the wellhead housing 1302. The locking mechanism 1320 may be landed upon the main body 1306 within the wellhead housing 1302. Lastly, the upper body 1304 may be coupled to the main body 1306 within the wellhead housing 1302. The wellhead housing 1302 may include a central bore 1310 having a locking profile 1312 disposed thereon. The locking mechanism 1320 may engage the locking profile 1312 of the wellhead housing 1302 in order to lock the hanger assembly 1300 in place within the wellhead housing 1302 and rigidize the system. In one or more embodiments, the locking mechanism 1320 may include a lock ring 1322 and an actuator 1324. The locking mechanism 1320 may be run into the wellhead housing 1302 until the locking mechanism 1320 abuts an upward-facing contact surface 1314 of the main body 1306. In one or more embodiments, a bottom surface of the lock ring 1322 may directly abut the upward-facing contact surface 1314 and may be pushed outward in a radial direction into the locking profile 1312 of the wellhead housing 1302 by a compressive force caused by the actuator 1324 pushing down axially on the lock ring 1322. In particular, the lock ring 1322 may have ridges 1326 disposed on its outer surface that may match the locking profile 1312 disposed along the central bore 1310 of the wellhead housing 1302.

The lock ring 1322 may be actuated by the actuator 1324 via an interface between the lock ring 1322 and the actuator 1324. The interface, according to one or more embodiments of the present disclosure, may allow axial force from the actuator 1324 to be transferred through the interface into outward radial expansion of the lock ring 1322 toward the locking profile 1312 on the inner diameter of the wellhead housing 1302. In particular embodiments, the interface may be designed to achieve a so-called two-stage locking. For example, the interface may be shaped such that (1) axially downward movement of the actuator 1324 from a starting position to an intermediate position may actuate the lock ring 1322 into the locking profile 1312; and (2) axially downward movement of the actuator 1324 from the intermediate position to a pre-load position may apply a pre-load to the hanger assembly 1300, the details of which will be discussed further below.

In the illustrated embodiment, the interface may include a single tapered surface 1328 of the actuator 1324 that is angled from vertical such that an upper portion of the actuator 1324 may have a greater diameter than a lower portion of the actuator 1324. As an example and not by way of limitation, the single tapered surface 1328 may be angled less than 4 degrees from vertical. As another example and not by way of limitation, the single tapered surface 1328 may be angled less than 2 degrees from vertical. Alternatively, one of ordinary skill in the art would understand that in other embodiments, the single tapered surface 1328 may be angled at any suitable angle from vertical without departing from the scope of the present disclosure. In the illustrated embodiment, the interface may also include an inner surface 1330 of the lock ring 1322 that is tapered to match the single tapered surface 1328 of the actuator 1324. When the actuator 1324 moves down in the axial direction, the single tapered surface 1328 may contact and press against the inner surface 1330 of the lock ring 1322, pushing the lock ring 1322 radially outward (by a horizontal component of the pressing force acting through the interface) until the lock ring 1322 engages into the locking profile 1312.

In one or more embodiments, axial downward movement of the actuator 1324 may be interrupted by a split ring 1332 such that the actuator 1324 is temporarily stopped at its intermediate position. In the illustrated embodiment, the split ring 1332 may be disposed along a radially inner surface of the upper body 1304. For example, the split ring 1332 may be disposed within a groove 1316 of the upper body 1304 and may have an unretracted outer diameter that is greater than the diameter of the upper body 1304. Axial location of the split ring 1332 may be disposed below the actuator 1324 in its starting state. This position of the split ring 1332 may be such that the upper portion of the actuator 1324 cannot contact the lock ring 1322 until the split ring 1332 is collapsed into the groove 1316. Further, the split ring 1332 may have an upper contact surface that is tapered such that additional downward forces from the actuator 1324 as it travels past the intermediate position during actuation may push on the upper contact surface and cause the split ring 1332 to retract into the groove 1316. In the retracted state, the radially outer surface of the split ring 1332 may stay flush with or short of the surface of the upper body 1304, thereby opening a passage for the actuator 1324 to press down further, e.g., past the split ring 1332 to the pre-load position. Thus, in one or more embodiments, the split ring 1332 needs to be retracted or collapsed in order for the actuator 1324 to be able to travel to the pre-load position. Although the present disclosure describes a hanger assembly with a split ring in a particular manner, the present disclosure contemplates hanger assemblies with any suitable split rings in any suitable manner. For example, additional or alternative to the split ring 1332 disposed in the upper body 1304, a split ring may be arranged in a running tool (not shown), which serves to apply weight to the actuator 1324, causing the actuator 1324 to move downward. In particular, the split ring may stay in its unretracted state under low pressure, causing the actuator 1324 to stop at the intermediate position, and may yield as more weight in the running tool is applied, thereby allowing the actuator 1324 to move past the intermediate position when pre-loading the hanger assembly 1300 within the wellhead housing 1302.

In certain embodiments, the hanger assembly 1300 may include another stopper, e.g., for temporarily stopping the actuator at its intermediate position according to one or more embodiments of the present disclosure. As an example, a shear pin may be disposed at the radially inner surface of the upper body 1304 to block travel path of the actuator 1324 at the intermediate position until a sufficient actuation force is applied to further press down the actuator 1324 and shear the shear pin when pre-loading the hanger assembly 1300 within the wellhead housing 1302. As another example, a shear pin may be disposed in a running tool (not shown), which serves to apply weight to the actuator 1324, causing the actuator 1324 to move downward. In particular, the shear pin may prevent movement of the actuator 1324 past the intermediate position until additional weight is added in the running tool to shear the shear pin when pre-loading the hanger assembly 1300 within the wellhead housing 1302. It should be understood that the shear pins described above are purely exemplary. Any suitable stopper feature may be employed without departing from the scope of the present disclosure. For example, one or more of a lock, a spring, a ring, a pin, a ratchet, or the like may be employed additionally or alternatively to temporarily retain the actuator 1324 at the intermediate position.

The hanger assembly 1300 as illustrated may include a space-out mechanism 1340 disposed between the main body 1306 and the lower body 1308, for example, to close out axial gaps in the wellhead and rigidize the system. In one or more embodiments, the space-out mechanism 1340 may include a ramp ring 1342, which may be configured to rotate relative to the main body 1306 and the lower body 1308, and a piston 1344, which may interface the ramp ring 1342. Specifically, the ramp ring 1342 may comprise at least one tapered surface 1346, and the piston 1344 may comprise at least one tapered surface configured to interface with the at least one tapered surface 1346 of the ramp ring 1342. The tapered surfaces of the ramp ring 1342 and the piston 1344 may be complementary. Furthermore, the tapered surfaces of the ramp ring 1342 and the piston 1344 may be configured to bear against each other to rigidize the system. In certain embodiments, the at least one taper of each of the ramp ring 1342 and the piston 1344 may have a slope between 0.5° and 7°. Additionally, in one or more embodiments, the ramp ring 1342 and the piston 1344 may take form similar to the ramp ring illustrated in detail in FIG. 3A and described above with reference to FIG. 3A. When actuated, the ramp ring 1342 may rotate out, thereby expanding the space-out mechanism 1340 to remove any axial gaps in the wellhead system created during installation. In certain embodiments, the ramp ring 1342 may function similar to the ramp ring illustrated in detail in FIG. 3A and described above with reference to FIG. 3A. Alternatively, the ramp ring 1342 may function similar to the ramp ring illustrated in detail in FIG. 12 and described above with reference to FIG. 12.

In certain embodiments, the hanger assembly 1300 may include a space-out mechanism release assembly 1350 configured to selectively release the space-out mechanism 1340 so that the space-out mechanism 1340 can actuate. In particular, a lever-actuated pin 1352 disposed within the main body 1306 may be installed during assembly of the hanger assembly 1300 and engage the ramp ring 1342 so as to rotationally lock the ramp ring 1342 to the main body 1306 until the proper time in the hanger assembly 1300 run-in sequence in which the ramp ring 1342 should be rotationally actuated in order to take up any axial space created by the installation procedure. Specifically, the lever-actuated pin 1352 may be levered to retract up and out of engagement with the ramp ring 1342 by a trigger rod 1354. In one or more embodiments, one end of the trigger rod 1354 may be coupled to the lever-actuated pin 1352 while the other end of the trigger rod 1354 may be coupled to the actuator 1324. Upon the actuator 1324 descending from the starting position to the intermediate position, the trigger rod 1354 may be pushed downward to lift up the lever-actuated pin 1352, thereby unlocking the ramp ring 1342 such that the ramp ring 1342 may be rotationally actuated as needed.

Alternatively, the space-out mechanism release assembly 1350 may be configured similar to the safety mechanism illustrated in detail in FIG. 4 and described above with reference to FIG. 4. For example, in certain embodiments, the space-out mechanism release assembly 1350 may be spring-loaded, pressure-actuated, or movable in any suitable manner without departing from the scope of the present disclosure in order to selectively retain or release the space-out mechanism 1340.

The embodiments illustrated in FIGS. 13A through 16C may be utilized in a subsea wellhead system. However, similar techniques may be used in land-based wellhead assemblies as well. In certain embodiments, the assembly of FIGS. 13A-16C may be utilized by performing a sequence of steps—one exemplary sequence is provided below.

First, the hanger assembly 1300 may be landed into and engaged with the wellhead housing 1302. Once the hanger assembly 1300 is in position, the running tool may be actuated with low pressure, causing the actuator 1324 to move downward with respect to the main body 1306 and the lock ring 1322, thereby expanding the lock ring 1322 radially towards and into the locking profile 1312 of the wellhead housing 1302. In particular, the actuator 1324 may move from the starting position until stopped at the intermediate position by the split ring 1332. Then, the space-out mechanism 1340 may be released for actuation. In one or more embodiments, the release of the space-out mechanism 1340 may occur in response to the actuator 1324 moving from the starting position to the intermediate position. For example, as the actuator 1324 descends, the trigger rod 1354 coupled to the actuator 1324 may push on the lever-actuated pin 1352, thereby unlocking the space-out mechanism 1340 by rotationally uncoupling the ramp ring 1342 and the main body 1306 so that the space-out mechanism 1340 may actuate as needed. Overpull may be applied on the running tool to pull up the hanger assembly 1300. In some embodiments, the overpull may pull about 50,000 lbs of tension. Of course, other suitable levels of overpull may be applied without departing from the scope of the present disclosure. Lifting the hanger assembly 1300 in the vertical direction may cause the upper surface of the lock ring 1322 to engage on the locking profile 1312 (e.g., on a topmost lockdown groove of the locking profile 1312) of the wellhead housing 1302. This may confirm that the hanger assembly 1300 is locked into the wellhead housing 1302 and the space-out mechanism 1340 will activate (e.g., via the piston 1344). Then, the overpull may be maintained to retain the hanger assembly 1300 at the lifted position. Pressure is exerted to seal the main body 1306. In certain embodiments, this may be performed in a way similar to the method described above with reference to FIG. 12. Upon sealing, the piston 1344 may be pressurized, thereby maintaining the space-out mechanism 1340 in its actuated position, thus ensuring proper space-out. Following confirmation that the main body 1306 is properly sealed and spaced out, pre-load may be applied to the hanger assembly 1300. In certain embodiments, the lock ring 1322 may be subjected to a pressure of about 15,000 psi or other suitable levels of pressure. This will expand the lock ring 1322 further into the locking profile 1312 of the wellhead housing 1302 and add significant pre-load to the hanger assembly 1300. In certain embodiments, the pre-load on the hanger assembly 1300 may be up to 100,000 lbs. Of course, other suitable levels of pre-load on the hanger assembly 1300 are also contemplated without departing from the scope of the present disclosure. Finally, the overpull may be removed, and the running tool may be unlatched and retrieved. The above list of steps should be understood as non-limiting—additional steps may be added or removed without departing from the scope of the present disclosure. Moreover, steps may be executed in a different order without departing from the scope of the present disclosure.

Referring now to FIGS. 17A-17D, interaction of a lock ring 1722 and an actuator 1724, according to one or more embodiments of the present disclosure, during installation is illustrated. The installation may be performed following the steps and sequence described with reference to FIGS. 13A, 14A, 15A, and 16A. Alternatively, as will be appreciated by one of skill in the art, the installation may be performed using less or more steps or executed in a different sequence without departing from the scope of the present disclosure. In the illustrated embodiments, the interaction of the lock ring 1722 and the actuator 1724 may occur via an interface 1700. The interface 1700 may include two flat surfaces 1726, 1728 of the actuator 1724 that are separated by a step 1730. For example, the two flat surfaces 1726, 1728, and the step 1730 may be formed on the outer surface of the actuator 1724 such that an upper portion of the actuator 1724 may have a greater diameter than a lower portion of the actuator 1724. While described as being flat, the two surfaces 1726, 1728 in some embodiments may alternatively be angled, tapered, or otherwise inclined from vertical if needed. Furthermore, the step 1730 may be slightly tapered as shown, or alternatively form an angle of about 90 degrees relative to the vertical. In one or more embodiments, the lock ring 1722 may have an inner surface that is shaped to match the outer surface of the actuator 1724. As a non-limiting example, the lock ring 1722 may also be structured with two flat surfaces separated by a step. During installation, at the starting position of the actuator 1724, the actuator 1724 may be spaced from contact the lock ring 1722. Actuating the actuator 1724 (e.g., under low pressure) may first cause the flat surface 1726 to contact the lock ring 1722 until the step 1730 catches an upper rim of the lock ring 1722 when the actuator 1724 moves from the starting position to the intermediate position. As the actuator 1724 continues to press down on the lock ring 1722 and moves from the intermediate position to the pre-load position (e.g., following the overpull and actuation of a space-out mechanism as described at length above), the flat surface 1728 may push against the lock ring 1722 to further expand the lock ring 1722 radially into the lock profile 1712, thereby adding a pre-load to the system.

Referring now to FIGS. 18A-18D, interaction of a lock ring 1822 and an actuator 1824, according to one or more embodiments of the present disclosure, during installation is illustrated. The installation may be performed following the steps and sequence described with reference to FIGS. 13A, 14A, 15A, and 16A. Alternatively, as will be appreciated by one of skill in the art, the installation may be performed using less or more steps or executed in a different sequence without departing from the scope of the present disclosure. In the illustrated embodiments, the interaction of the lock ring 1822 and the actuator 1824 may occur via an interface 1800. The interface 1800 may include a flat surface 1826 of the actuator 1824 and a tapered surface 1828 of the actuator 1824. The flat surface 1826 may be located vertically below the tapered surface 1828 such that an upper portion of the actuator 1824 may have a greater diameter than a lower portion of the actuator 1824. The flat surface 1826 and the tapered surface 1828 may be continuously connected or otherwise separated by a step (not shown). In one or more embodiments, the lock ring 1822 may have an inner surface that is shaped to match the outer surface of the actuator

1824. As a non-limiting example, the lock ring 1822 may also be structured with a flat surface and a tapered surface. During installation, at the starting position of the actuator 1824, the actuator 1824 may be spaced from contact the lock ring 1822. Actuating the actuator 1824 (e.g., under low pressure) may first cause the flat surface 1826 to contact the lock ring 1822 until the connection between the flat surface 1826 and the tapered surface 1828 contacts an upper rim of the lock ring 1822 when the actuator 1824 moves from the starting position to the intermediate position. As the actuator 1824 continues to press down on the lock ring 1822 and moves from the intermediate position to the pre-load position (e.g., following the overpull and actuation of a space-out mechanism as described at length above), the tapered surface 1828 may push against the lock ring 1822 to further expand the lock ring 1822 radially into the lock profile 1812, thereby adding a pre-load to the system.

Referring now to FIGS. 19A-19D, interaction of a lock ring 1922 and an actuator 1924, according to one or more embodiments of the present disclosure, during installation is illustrated. The installation may be performed following the steps and sequence described with reference to FIGS. 13A, 14A, 15A, and 16A. Alternatively, as will be appreciated by one of skill in the art, the installation may be performed using less or more steps or executed in a different sequence without departing from the scope of the present disclosure. In the illustrated embodiments, the interaction of the lock ring 1922 and the actuator 1924 may occur via an interface 1900. The interface 1900 may include a tapered surface 1926 of the actuator 1924. The tapered surface 1926 may be sloped from vertical at a low angle such that an upper portion of the actuator 1924 may have a slightly greater diameter than a lower portion of the actuator 1924. As an example and not by way of limitation, the tapered surface 1926 may be angled less than 4 degrees from vertical. As another example and not by way of limitation, the tapered surface 1926 may be angled less than 2 degrees from vertical. Alternatively, one of ordinary skill in the art would understand that in other embodiments, the single tapered surface 1926 may be angled at any suitable angle from vertical without departing from the scope of the present disclosure. In one or more embodiments, the lock ring 1922 may have an inner surface that is shaped to match the outer surface of the actuator 1924. As a non-limiting example, the lock ring 1922 may also be structured with a tapered surface that is sloped from vertical at a low angle. During installation, at the starting position of the actuator 1924, the actuator 1924 may be spaced from contact the lock ring 1922. Actuating the actuator 1924 from the starting position to the intermediate position as well as from the intermediate position to the pre-load position may cause the tapered surface 1926 to contact the lock ring 1922 to expand the lock ring 1922 radially into the lock profile 1912.

It should be understood that the present disclosure contemplates a method to lock and rigidize a seal assembly and casing hanger within a wellhead housing. The present disclosure also contemplates a method to assemble a seal assembly.

In one or more embodiments of the present disclosure, assembling the seal assembly may include disposing a space-out mechanism between an upper body and a lower body of the seal assembly. Then, in one or more embodiments including a safety mechanism for locking a rotation of the ramp ring relative to the upper body, the portions of the safety mechanism in the ramp ring and in the upper body may be aligned and coupled. This may further include disposing a safety lock spring in a pin blind hole, disposing a safety lock pin on top of the safety lock spring in the pin blind hole, and disposing a pin securing mechanism into the opening of the pin blind hole. Further, once the safety mechanism for locking a rotation of the ramp ring relative to the upper body is properly aligned and the safety lock pin is inserted into the pin counterbore of the tubing hanger body, a spring-loaded rod may be disposed within an elongated hole in the upper body. Further, if a space-out mechanism requires a pre-load to be applied to a mechanism configured to rotate the ramp ring relative to the upper body, the pre-load will be applied before rotationally locking the ramp ring and the upper body by way of the safety mechanism.

Then, in one or more embodiments, a pressure-actuated release mechanism is used to secure the upper body to the lower body in an axial direction, with the ramp ring between a lower edge of the upper body and an upper edge of the lower body.

Additionally, in one or more embodiments of the present disclosure, locking and rigidizing the seal assembly and casing hanger within a wellhead housing may include running an assembled seal assembly into the wellhead housing, landing the seal assembly on the casing hanger and sealing a seal of the seal assembly between the casing hanger and the wellhead housing. The seal assembly may then be locked to the wellhead housing. The process of locking the seal assembly may engage the locking mechanism into its locking profile within the wellhead housing. At the same time, the process of locking the locking mechanism may unlock a safety mechanism by compressing a spring-loaded rod into an elongated hole of the upper body and pushing a safety lock pin out of a pin counterbore of the upper body such that the ramp ring is no longer rotationally locked to the upper body. Then, the seal assembly may be lifted to preload the locking mechanism in place within the wellhead housing.

In one or more embodiments, the space-out mechanism may then be actuated, taking up any axial gaps created by lifting on the seal assembly and rigidizing the seal assembly within the wellhead housing. Actuating the space-out mechanism may further include pressuring down an annulus between the casing hanger and a seal on the lower body to apply a downward force to the lower body, thereby shearing a pressure-actuated mechanism to enable the lower body to move downward with respect to the upper body. Moving the lower body in this manner causes the ramp ring to rotate, filling the gap between the lower body and the upper body. Once the space-out mechanism has been activated to rigidize the seal assembly and the casing body within the wellhead housing, the casing hanger seal may be seal tested to ensure that it is still properly sealing. Then, finally, the seal assembly may be released.

The disclosure includes the following illustrative embodiments.

A seal assembly, including: an upper body; a lower body having a seal for sealing between a first wellhead system component and a second wellhead system component; and a space-out mechanism disposed between the upper body and the lower body, the space-out mechanism including a ramp ring having at least one tapered surface, wherein the upper body has at least one tapered surface configured to interface with the at least one tapered surface of the ramp ring, wherein the ramp ring is configured to rotate relative to the upper body and the lower body, and wherein the at least one tapered surface of the ramp ring and the at least one tapered surface of the upper body are configured to bear against each other to rigidize the system.

The seal assembly provided above may include any one or more of the following features: Feature 1: the tapered surfaces of the ramp ring and the upper body are complementary. Feature 2: the taper of the at least one tapered surface of the ramp ring and the taper of the at least one tapered surface of the upper body have a slope between 0.5° and 7°. Feature 3: one or more of the ramp ring and the upper body have exactly three tapered surfaces. Feature 4: one or more pressure-actuated release mechanisms coupled between the upper body and the lower body. Feature 5: at least one of the one or more pressure-actuated release mechanisms is a shear pin. Feature 6: a spring coupled to the ramp ring and operable to circumferentially drive the ramp ring. Feature 7: a safety mechanism disposed at an interface of the upper body with the ramp ring, wherein the safety mechanism is configured to prevent rotation of the ramp ring with respect to the upper body until the safety mechanism is released.

A system including: a wellhead; a casing hanger disposed at least partially in the wellhead; and a seal assembly, including: a space-out mechanism, the space-out mechanism including a ramp ring having at least one tapered surface; an upper body having at least one tapered surface configured to interface with the at least one tapered surface of the space-out mechanism; and a lower body having a seal for sealing between the casing hanger and the wellhead, wherein the ramp ring is configured to rotate relative to the upper body and the lower body, and wherein the at least one tapered surface of the ramp ring and the at least one tapered surface of the upper body are configured to bear against each other to rigidize the system.

The system provided above may include any one or more of the following features: Feature 1: the tapered surfaces of the ramp ring and the upper body are complementary. Feature 2: the taper of the at least one tapered surface of the ramp ring and the taper of the at least one tapered surface of the upper body have a slope between 0.5° and 7°. Feature 3: one or more of the ramp ring and the upper body have three tapered surfaces. Feature 4: one or more pressure-actuated release mechanisms coupled between the upper body and the lower body. Feature 5: at least one of the one or more pressure-actuated release mechanisms is a shear pin. Feature 6: the wellhead is a subsea wellhead.

A method, including: running a seal assembly into a wellhead housing until the seal assembly lands on a casing hanger; locking the seal assembly to the wellhead housing; lifting the seal assembly; and actuating a space-out mechanism of the seal assembly to rigidize the seal assembly within the wellhead housing, wherein the space-out mechanism includes a ramp ring having at least one tapered surface, and wherein an upper body of the seal assembly has at least one tapered surface configured to interface with the at least one tapered surface of the space-out mechanism.

The method provided above may include any one or more of the following features: Feature 1: actuating the space-out mechanism expands at least a portion of the space-out mechanism to rigidize the tubing hanger system within the wellhead housing. Feature 2: actuating the space-out mechanism includes applying a pressure to the seal assembly to actuate one or more pressure-actuated release mechanisms. Feature 3: sealing a space between the wellhead housing and the casing hanger via a seal located on a lower body of the seal assembly. Feature 4: releasing a safety mechanism in response to movement of an actuator sleeve that locks the seal assembly to the wellhead housing, wherein the safety mechanism prevents rotation of the ramp ring with respect to the upper body until it is released.

Although the present disclosure and its advantages have been described in detail, it should be understood that various changes, substitutions and alterations can be made herein without departing from the spirit and scope of the disclosure as defined by the following claims.

What is claimed is:

1. A hanger assembly, comprising:

a main body;

a lock ring coupled to the main body and configured to expand radially outward into a profile on an inner diameter of a wellhead; and an actuator, wherein the actuator is capable of transferring an axial force from the actuator into outward radial expansion of the lock ring toward the profile on the inner diameter of the wellhead;

a trigger rod coupled to the actuator and configured to unlock a space-out mechanism disposed between the main body and the lower body for actuation;

wherein an interface between the actuator and the lock ring is shaped such that:

axially downward movement of the actuator from a starting position to an intermediate position actuates the lock ring into the profile; and axially downward movement of the actuator from the intermediate position to a pre-load position applies a pre-load to the hanger assembly.

2. The hanger assembly of claim 1, wherein the actuator comprises a single tapered surface to interface with the lock ring.

3. The hanger assembly of claim 2, further comprising:

an upper body coupled to the main body; and a split ring disposed along a radially inner surface of the upper body and configured to stop the axially downward movement of the actuator at the intermediate position.

4. The hanger assembly of claim 3, wherein the split ring is configured to retract into the radially inner surface of the upper body in response to additional axial force from the actuator to allow the axially downward movement of the actuator from the intermediate position to the pre-load position.

5. The hanger assembly of claim 2, wherein the single tapered surface is angled less than 4 degrees from vertical.

6. The hanger assembly of claim 5, wherein the single tapered surface is angled less than 2 degrees from vertical.

7. The hanger assembly of claim 1, wherein the actuator comprises two flat surfaces to interface with the lock ring, the two flat surfaces being separated by a step.

8. The hanger assembly of claim 1, wherein the actuator comprises a flat surface and a tapered surface to interface with the lock ring, the flat surface being located vertically below the tapered surface.

9. The hanger assembly of claim 1, further comprising:

the lower body; and wherein the space-out mechanism comprising a ramp ring having at least one tapered surface.

10. The hanger assembly of claim 9, further comprising:

a space-out mechanism release assembly configured to selectively release the space-out mechanism so that the space-out mechanism actuates; and wherein the trigger rod is configured to actuate the space-out mechanism release assembly upon the actuator moving to the intermediate position.

11. A method for installing a hanger assembly in a wellhead, comprising:

positioning the hanger assembly into the wellhead, the hanger assembly comprising a main body, a lower body coupled to the main body, a lock ring coupled to the main body, and an actuator;

moving the actuator axially downward with respect to the main body from a starting position to an intermediate position, wherein this movement of the actuator expands the lock ring radially outwardly into a profile on an inner diameter of the wellhead;

unlocking a space-out mechanism disposed between the main body and the lower body so that the space-out mechanism actuates in response to the actuator moving from the starting position to the intermediate position, wherein a trigger rod is coupled to the actuator and configured to unlock the space-out mechanism upon the actuator moving to the intermediate position;

actuating the space-out mechanism; and moving the actuator axially downward from the intermediate position to a pre-load position, wherein this movement of the actuator applies a pre-load to the hanger assembly.

12. The method of claim 11, further comprising:

stopping the actuator at the intermediate position via a split ring disposed along a radially inner surface of an upper body coupled to the main body;

retracting the split ring into the radially inner surface of the upper body in response to additional axial force from the actuator; and contacting a tapered surface of the actuator with the lock ring during movement of the actuator from the intermediate position to the pre-load position.

13. The method of claim 11, further comprising:

contacting a first flat surface of the actuator with the lock ring during the movement of the actuator from the starting position to the intermediate position; and contacting a second flat surface of the actuator with the lock ring during the movement of the actuator from the intermediate position to the pre-load position, wherein the second flat surface is separated from the first flat surface by a step.

14. The method of claim 11, further comprising:

contacting a flat surface of the actuator with the lock ring during the movement of the actuator from the starting position to the intermediate position; and contacting a tapered surface of the actuator with the lock ring during the movement of the actuator from the intermediate position to the pre-load position, wherein the flat surface is located vertically below the tapered surface.

15. The method of claim 11, further comprising contacting a single tapered surface of the actuator with the lock ring during both the movement of the actuator from the starting position to the intermediate position and the movement of the actuator from the intermediate position to the pre-load position, wherein the single tapered surface is angled less than 4 degrees from vertical.

16. The method of claim 15, wherein the single tapered surface is angled less than 2 degrees from vertical.

17. The method of claim 11, wherein the space-out mechanism comprises a ramp ring having at least one tapered surface, and wherein actuating the space-out mechanism expands at least a portion of the space-out mechanism to rigidize the hanger assembly within the wellhead.

18. The method of claim 17, further comprising, after the actuator reaches the intermediate position, applying an overpull to lift the hanger assembly in a vertical direction relative to the wellhead to actuate the space-out mechanism.

19. The method of claim 17, further comprising maintaining the space-out mechanism in its actuated position during movement of the actuator from the intermediate position to the pre-load position.

* * * * *